US009572422B2

(12) United States Patent
Ergun et al.

(10) Patent No.: US 9,572,422 B2
(45) Date of Patent: Feb. 21, 2017

(54) HEIGHT ADJUSTABLE DESK SYSTEM AND METHOD

(71) Applicant: Ergotron, Inc., St. Paul, MN (US)

(72) Inventors: Mustafa A. Ergun, Plymouth, MN (US); Shaun Christopher Lindblad, Lino Lakes, MN (US)

(73) Assignee: Ergotron, Inc., St. Paul, MN (US)

( * ) Notice: Subject to any disclaimer, the term of this patent is extended or adjusted under 35 U.S.C. 154(b) by 0 days.

(21) Appl. No.: 14/822,416

(22) Filed: Aug. 10, 2015

(65) Prior Publication Data

US 2016/0037907 A1 Feb. 11, 2016

Related U.S. Application Data

(60) Provisional application No. 62/035,700, filed on Aug. 11, 2014.

(51) Int. Cl.
*A47B 9/00* (2006.01)
*A47B 9/12* (2006.01)
(Continued)

(52) U.S. Cl.
CPC . *A47B 9/12* (2013.01); *A47B 9/02* (2013.01); *A47B 9/20* (2013.01)

(58) Field of Classification Search
CPC ..... A47B 9/02; A47B 9/10; A47B 9/12; A47B 9/20
(Continued)

(56) References Cited

U.S. PATENT DOCUMENTS 4,351,245 A 9/1982 Laporte
4,651,652 A * 3/1987 Wyckoff ..... A47B 9/12 108/147
(Continued)

FOREIGN PATENT DOCUMENTS

DE 1554359 A1 11/1969
DE 1554360 A1 11/1969
(Continued)

OTHER PUBLICATIONS

"International Application Serial No. PCT/US2015/044466, International Search Report mailed Oct. 20, 2015", 5 pgs.
(Continued)

*Primary Examiner* — Janet M Wilkens
(74) *Attorney, Agent, or Firm* — Schwegman Lundberg & Woessner, P.A.

(57) ABSTRACT

In an example, a lift mechanism can comprise: a first leg assembly, the first leg assembly including: a first member; and a second member moveable relative to the first member along a first longitudinal axis; a second leg assembly, the second leg assembly including: a third member; and a fourth member moveable relative to the third member along a second longitudinal axis; and a synchronization assembly connecting the first and second leg assemblies, the synchronization assembly configured to balance movement between the first and second leg assemblies, the synchronization assembly including a wheel assembly, the wheel assembly connected to a first tension member and a second tension member, the first tension member connected to at least one of the first leg assembly and the second leg assembly and the second tension member connected at least one of the first leg assembly and the second leg assembly.

18 Claims, 21 Drawing Sheets

(51) Int. Cl.
*A47B 9/20* (2006.01)
*A47B 9/02* (2006.01)

(58) Field of Classification Search
USPC ..... 108/147, 147.19; 248/188.5, 404, 161, 248/405, 414, 159, 157, 188.2
See application file for complete search history.

(56) References Cited

U.S. PATENT DOCUMENTS

| | | | | |
|---|---|---|---|---|
| 5,114,109 | A | 5/1992 | Fitz et al. | |
| 5,311,827 | A * | 5/1994 | Greene | A47B 9/02 108/147 |
| 5,400,721 | A | 3/1995 | Greene | |
| 6,152,049 | A | 11/2000 | Schmidt | |
| 6,412,427 | B1 | 7/2002 | Merkt | |
| 7,364,124 | B2 | 4/2008 | Yuasa et al. | |
| 7,412,931 | B2 * | 8/2008 | Seidl | A47B 9/02 108/147 |
| 8,333,159 | B2 | 12/2012 | Schroer et al. | |
| 8,342,465 | B2 | 1/2013 | Koder | |
| 9,038,549 | B1 * | 5/2015 | Zebarjad | A47B 9/02 108/147 |
| 9,232,855 | B2 * | 1/2016 | Ergun | A47B 9/02 |
| 2005/0002591 | A1 | 1/2005 | Buitmann | |
| 2011/0049291 | A1 * | 3/2011 | Piezunka | B64D 41/00 244/54 |
| 2012/0227642 | A1 * | 9/2012 | Sekikawa | A47B 9/10 108/147 |
| 2013/0126682 | A1 | 5/2013 | Tholkes et al. | |
| 2015/0047538 | A1 * | 2/2015 | Ergun | A47B 9/02 108/147 |
| 2015/0320198 | A1 | 11/2015 | Zebarjad et al. | |

FOREIGN PATENT DOCUMENTS

| | | | |
|---|---|---|---|
| DE | 29600203 | U1 | 3/1996 |
| DE | 19756725 | | 7/1999 |
| DE | 20001056 | U1 | 6/2000 |
| DE | 10216774 | A1 | 10/2003 |
| EP | 040685 | A1 | 12/1991 |
| EP | 0963717 | A2 | 12/1999 |
| EP | 1050242 | A2 | 11/2000 |
| EP | 2250925 | * | 11/2010 |
| EP | 2250925 | A1 | 11/2010 |
| EP | 1987734 | B1 | 12/2010 |
| EP | 2422647 | A1 | 2/2012 |
| WO | WO-2008145399 | A1 | 12/2008 |
| WO | WO-2012025593 | A1 | 3/2012 |
| WO | WO-2016025387 | A1 | 2/2016 |

OTHER PUBLICATIONS

"International Application Serial No. PCT/US2015/044466, Written Opinion mailed Oct. 20, 2015", 8 pgs.

* cited by examiner

HEIGHT ADJUSTABLE DESK SYSTEM AND METHOD

CLAIM OF PRIORITY

This patent application claims the benefit of priority, under 35 U.S.C. Section 119(e), to U.S. Provisional Patent Application Ser. No. 62/035,700 to Ergun et al., titled "HEIGHT ADJUSTABLE DESK SYSTEM AND METHOD" and filed on Aug. 11, 2014, which is hereby incorporated by reference herein in its entirety.

TECHNICAL FIELD

This disclosure generally relates to systems and methods for height adjustable desks.

BACKGROUND

Height adjustable desks can be used in sit-to-stand applications or other applications.

SUMMARY

This disclosure provides unique systems and methods for height adjustable desks. For the purposes of this disclosure, the term "desk" can include any sort of desk, table, work surface or display surface. Examples of height adjustable desks provided in this disclosure can include telescoping legs having at least two tubes. For the purposes of this disclosure, the term "riser" can include any sort of leg or extending member that can provide support for a desk. Risers or leg assemblies can include tubular members having various diameters so that they can be located inside each other. Mating tubular members can be configured in any cross-sectional shape, such as rectangular, round, or oval. Tubular members can be slidably engaged and connected together via a telescoping mechanism. One of the tubular members can be fixed, and one or more other tubular members or brackets can slide out of the fixed leg assembly to provide height adjustment. When combined, the telescoping legs can provide a highest desk height required for tall users in a standing position, and, when the tubular members collapse, the telescoping legs can provide a lowest desk height required by shorter users in a seated position.

In some examples, the telescoping legs can include a counterbalancing mechanism, such as a rotary cam mechanism. In some examples, a counterbalancing mechanism can be included in each leg of a height adjustable desk. The legs can be used individually as a single leg centered under a desk surface, or two or more synchronized legs can be used under the desk surface for height adjustment. In other examples, the counterbalancing mechanism can be located between the legs and parallel to the desk surface.

In another example, an adjustable desk can include a weight counterbalance mechanism using a gas spring and a pulley assembly. This example can be applied to 2-member or 3-member telescoping leg assemblies, as well as non-telescoping leg assemblies to support a work surface. A work surface can be supported by a single leg assembly or multiple leg assemblies. If multiple leg assemblies were used to support the work surface, a synchronization method can be included to achieve equal height adjustment in all leg assemblies. In this disclosure, using a pulley arrangement in association with a gas spring, a total height adjustment of two times the gas spring stroke can be achieved. In this disclosure, a leg assembly or riser can be any generally vertical supporting structure and the terms can be used interchangeably.

To further illustrate the HEIGHT ADJUSTABLE DESK SYSTEM AND METHOD disclosed herein, a non-limiting list of examples is provided here:

In Example 1, a lift mechanism can comprise: a first leg assembly, the first leg assembly including: a first member; and a second member moveable relative to the first member along a first longitudinal axis; a second leg assembly, the second leg assembly including: a third member; and a fourth member moveable relative to the third member along a second longitudinal axis. The lift mechanism can also comprise: a synchronization assembly connecting the first and second leg assemblies, the synchronization assembly configured to balance movement between the first and second leg assemblies, the synchronization assembly including a wheel assembly, the wheel assembly connected to a first tension member and a second tension member, the first tension member connected to at least one of the first leg assembly and the second leg assembly and the second tension member connected at least one of the first leg assembly and the second leg assembly.

In Example 2, the lift mechanism of Example 1 can optionally be configured such that the wheel assembly comprises a first wheel and a second wheel, the first wheel and the second wheel rotatingly coupled to an underside of a work surface.

In Example 3, the lift mechanism of Example 2 can optionally be configured such that the first wheel is affixed to the second wheel and the first wheel and the second wheel have a shared axis of rotation.

In Example 4, the lift mechanism of Example 2 can optionally be configured such that first wheel and the second wheel are integrally formed and have a shared axis of rotation.

In Example 5, the lift mechanism of Example 2 can optionally be configured such that the wheel assembly comprises a flexible member extending around at least a portion of each of the first wheel and the second wheel, the first wheel and the second wheel configured to rotate in unison when the flexible member moves.

In Example 6, the lift mechanism of any one or any combination of Examples 1-5 can optionally be configured such that the first tension member and the second tension member each form a continuous tension member with a midpoint attachment to the wheel assembly, the first tension member having two ends attached to at least one of the first leg assembly and the second leg assembly, the second tension member having two ends attached to at least one of the first leg assembly and the second leg assembly.

In Example 7, the lift mechanism of any one or any combination of Examples 1-5 can optionally be configured such that, the synchronization assembly includes a third tension member connected to the wheel assembly and the synchronization assembly including a fourth tension member connected to the wheel assembly.

In Example 8, the lift mechanism of Example 7 can optionally be configured to further comprise a first pulley rotationally attached near the top of the second member, a second pulley rotationally attached near the top of the second member; and a third pulley rotationally attached near the bottom of the second member, wherein the first tension member extends around the first pulley and the third pulley and is attached to the first member.

In Example 9, the lift mechanism of any one or any combination of Examples 7-8 can optionally be configured to further comprise: a fourth pulley rotationally attached near the top of the fourth member; a fifth pulley rotationally attached near the top of the fourth member; and a sixth pulley rotationally attached near the bottom of the fourth member, wherein the third tension member extends around the fourth pulley and the sixth pulley and is attached to the third member.

In Example 10, the lift mechanism of any one or any combination of Examples 7-9 can optionally be configured to further comprise: a first idler pulley rotationally attached to the underside of the work surface and a second idler pulley rotationally attached to the underside of the work surface.

In Example 11, the lift mechanism of any one or any combination of Examples 1-10 can optionally be configured to further comprise: a counterbalance mechanism connected to the lift mechanism and configured to counteract a force exerted on the work surface, the counterbalance mechanism including: a gas spring having a cylinder and a moveable piston; and a wheel moveably connected to the gas spring; and a counterbalance tension member engaged to the wheel, the counterbalance tension member connected to at least one of the first leg assembly and the second leg assembly.

In Example 12, the lift mechanism of Example 11 can optionally be configured such that the first leg assembly includes a first gas spring of a first counterbalance mechanism and the second leg assembly includes a second gas spring of a second counterbalance mechanism.

In Example 13, the lift mechanism of Example 11 can optionally be configured such that the gas spring is attached to the underside of the work surface.

In Example 14, the lift mechanism of any one or any combination of Examples 1-13 can optionally be configured such that the first leg assembly includes a fifth member moveable relative to the second member and wherein the second leg assembly includes a sixth member moveable relative to the fourth member.

In Example 15, the lift mechanism of Example 14 can optionally be configured to further comprise: a counterbalance mechanism configured to counteract a force exerted on the work surface, the counterbalance mechanism including: a first gas spring having a moveable piston slidably attached to a cylinder, the cylinder attached to a first end of one of the second member and the fourth member; a second gas spring attached to a second end of the one of the second member and the fourth member, the second gas spring extending in an opposite direction from the first gas spring.

In Example 16, a height adjustable desk can comprise: a first leg assembly connected to a work surface, the first leg assembly including: a first member; and a second member moveable relative to the first member along a first longitudinal axis; a second leg assembly connected to the work surface, the second leg assembly including: a third member; and a fourth member moveable relative to the third member along a second longitudinal axis. The height adjustable desk can also comprise: a synchronization assembly connecting the first and second leg assemblies, the synchronization assembly configured to balance movement between the first and second leg assemblies, the synchronization assembly including a wheel assembly, the wheel assembly connected to a first tension member and a second tension member, the first tension member connected to at least one of the first leg assembly and the second leg assembly and the second tension member connected at least one of the first leg assembly and the second leg assembly.

In Example 17, the height adjustable desk of Example 16 can optionally be configured such that the wheel assembly comprises a first wheel and a second wheel, the first wheel and the second wheel rotatingly coupled to an underside of the work surface.

In Example 18, a method can comprise: providing a desk having: a work surface; a first leg assembly, coupled to the work surface, the first leg assembly including: a first member; and a second member moveable relative to the first member along a first longitudinal axis; a first pulley, rotationally coupled to the second member near a bottom of the second member; a second pulley, rotationally coupled to the second member near a top of the second member; a third pulley, rotationally coupled to the second member near a top of the second member; a second leg assembly, coupled to the work surface, the second leg assembly including: a third member; and a fourth member moveable relative to the third member along a second longitudinal axis; a fourth pulley, rotationally coupled to the fourth member near a bottom of the fourth member; a fifth pulley, rotationally coupled to the fourth member near a top of the fourth member; a sixth pulley, rotationally coupled to the fourth member near a top of the fourth member; providing a wheel assembly having a first wheel and a second wheel, the first wheel and the second wheel rotatingly coupled to an underside of the work surface; a first tension member connected to the wheel assembly, extending around the third pulley and connected to the first member; a second tension member connected to the wheel assembly and to the first member; a third tension member connected to the wheel assembly, extending around the sixth pulley and connected to the third member; a fourth tension member connected to the wheel assembly and to the third member; in response to a height adjustment of the work surface, synchronizing vertical movement of the second member relative to movement of the fourth member, the synchronizing vertical movement comprising: adjusting the length of a portion of the first tension member located between the first pulley and the connection to the first member by a first distance; adjusting the length of a portion of the second tension member located between the second pulley and the connection to the first member by a second distance, wherein the first distance and the second distance are substantially equal and opposite such that when a first distance is an increase, the second distance is a decrease and when the first distance is a decrease, the second distance is an increase; adjusting the length of a portion of the third tension member located between the third pulley and the connection to the third member by the first distance; and adjusting the length of a portion of the fourth tension member located between the fourth pulley and the connection to the third member by the second distance.

In Example 19, the method of Example 18 can optionally be configured such that the wheel assembly comprises a flexible member extending around at least a portion of each of the first wheel and the second wheel, the first wheel and the second wheel configured to rotate in unison when the flexible member moves.

In Example 20, the method of Example 18 can optionally be configured such that the first wheel and the second wheel are rotationally coupled together and share a common axis.

In Example 21, the lift mechanism or height adjustable desk or method of any one or any combination of Examples 1-20 can optionally be configured such that all elements, operations, or other options recited are available to use or select from.

These and other examples and features of the present lift mechanism, height adjustable desk, and methods will be set forth in part in the following drawings and Detailed Description. This Overview is intended to provide non-limiting examples of the present subject matter—it is not intended to provide an exclusive or exhaustive explanation. The Detailed Description below is included to provide further information about the present lift mechanism, height adjustable desk, and methods.

The details of one or more aspects of the disclosure are set forth in the accompanying drawings and the description below. Other features, objects, and advantages will be apparent from the description and drawings, and from the claims.

BRIEF DESCRIPTION OF THE DRAWINGS

Corresponding reference characters indicate corresponding parts throughout the several views. The exemplifications set out herein illustrate exemplary examples of this disclosure, and such exemplifications are not to be construed as limiting the scope of this disclosure in any manner.

DETAILED DESCRIPTION

Figure 1:
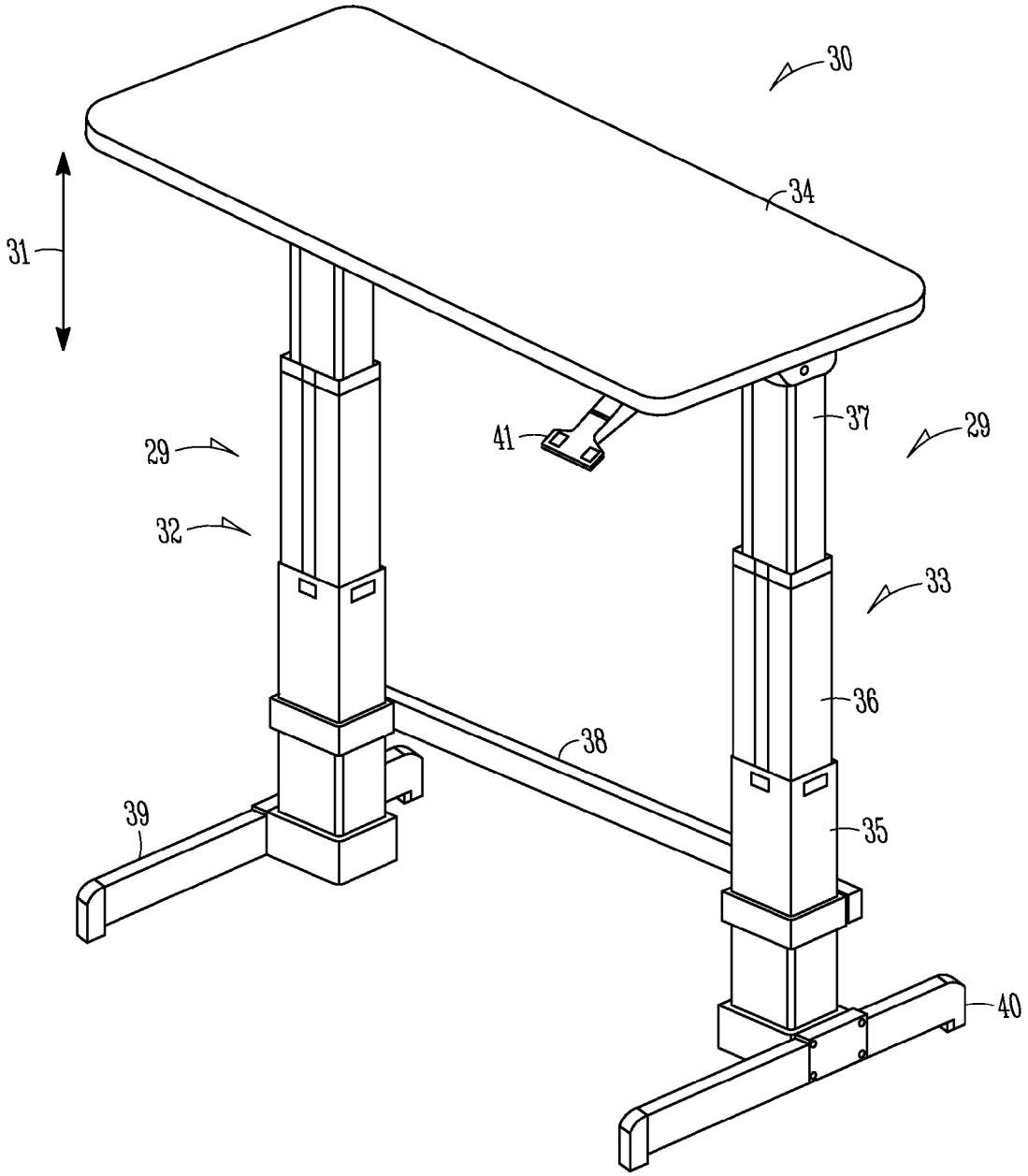
FIG. 1 illustrates a perspective view of a height adjustable desk with telescoping legs in accordance with at least one example of this disclosure.

FIG. 1 illustrates a perspective view of a height adjustable desk 30 with telescoping legs in accordance with at least one example of this disclosure. The height adjustable desk 30 can include at least one leg assembly 29 or riser to provide a height adjustment 31. Height adjustable desk 30 is illustrated including two legs, a first leg assembly 32, and a second leg assembly 33 located under a work surface 34 which can be a desk top or table top. Each leg can include two or more tubes or riser members and in FIG. 1 the height adjustable desk 30 can include three tubes or members: a first member 35, a second member 36 and a third member 37 in a telescopic nested arrangement. In some examples, the first and second leg assemblies 32, 33 can be connected together with a cross bar 38. In other examples, the cross bar 38 may not be needed. Each of the first and second leg assemblies 32, 33 can be attached to a first foot 39 and a second foot 40 at the bottom end and attached to a bottom surface (not shown) of the desk surface at the upper end. One or both leg assemblies can include a brake mechanism to secure the desk surface at a desired height. When needed, a user can actuate a brake handle 41 to unlock a brake mechanism (not depicted) and move the work surface 34 to a second height. When the brake handle 41 is released, work surface 34 is secured at the second height. In some examples, a counterbalancing mechanism can be located inside one or more legs. In other examples, the counterbalancing mechanism can be located under the work surface 34 and external to either leg. Work surface 34 can be attached to the upper end of one or more first and second leg assemblies 32, 33, and the first and second foot 39, 40 can be attached to the lower end of each first and second leg assembly 32, 33. In some configurations, casters 45 (see FIG. 2) may be attached to the bottom of the first and second foot 39, 40 to provide mobility.

Figure 2:
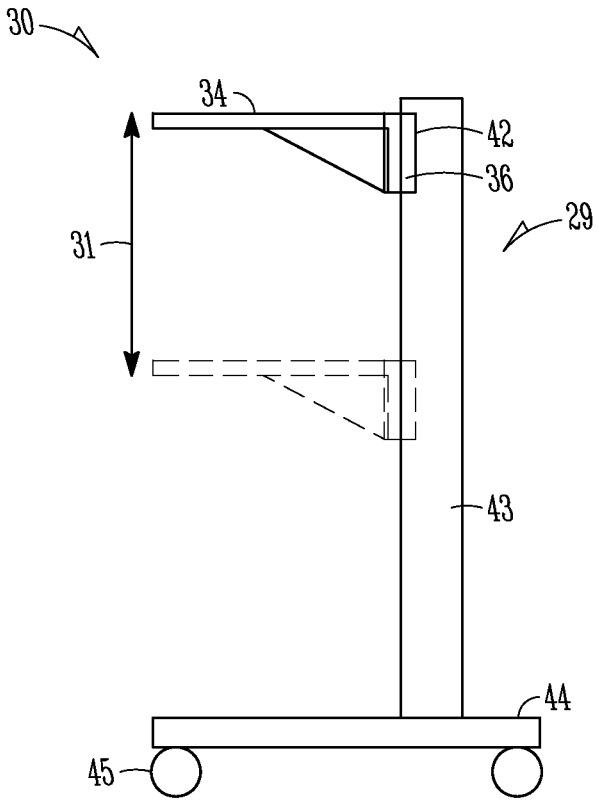
FIG. 2 illustrates a side view of a height adjustable desk with a fixed height leg and a moving bracket in accordance with at least one example of this disclosure.

FIG. 2 illustrates a side view of a height adjustable desk 30 with a fixed height leg and a moving bracket in accordance with at least one example of this disclosure. In other examples, leg assemblies 29 may be at a fixed height, and a moveable bracket 42 can be slidably engaged with the leg assembly 29 and can provide the height adjustment 31 as illustrated in FIG. 2. A fixed height first member 43 can be attached to the top of a base 44. The base 44 can include casters 45 that can provide mobility to the unit. A second member 36, such as the moveable bracket 42, can be slidably engaged with the fixed height first member 43. A work surface 34 can be attached to the moveable bracket 42. The moveable bracket 42 can be supported by a counterbalance mechanism 46 (see FIG. 3) located inside the fixed height first member 43. The counterbalance mechanism 46 can be any one of a gas spring, a pulley system attached to an energy storage member, an electric motor, a linear actuator, a hydraulic actuator, or other similar devices or methods.

Figures 3A, 3B:
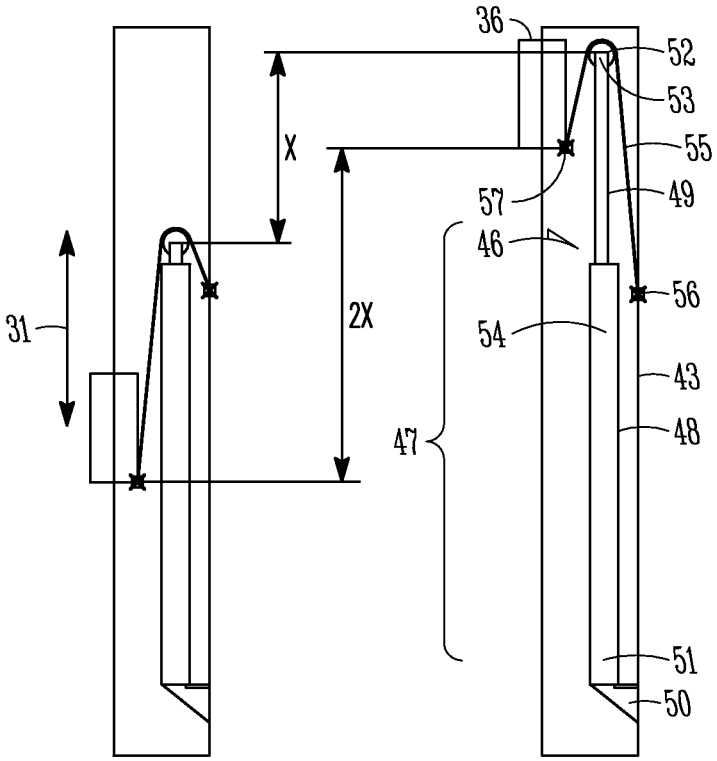
FIGS. 3A-B illustrate a side view of a counterbalance mechanism in accordance with at least one example of this disclosure.

FIG. 3 illustrates a side view of a counterbalance mechanism 46 in accordance with at least one example of this disclosure. The counterbalance mechanism 46 can include a gas spring 47. The gas spring 47 can include a cylinder 48 and a piston 49 and the piston 49 can move in and out of the cylinder 48. The gas spring 47 can be attached to the fixed height first member 43 via a support bracket 50. The support bracket 50 can be fixedly attached to the fixed height first member 43, and it can be located anywhere along the length of the fixed height first member 43. A cylinder base 51 can be attached to the support bracket 50. The piston 49 can be allowed to move in and out of the gas spring 47 during a height adjustment 31. A pulley 52 can be rotatingly coupled with the piston 49 on a piston outer end 53. An interface bracket (not shown in the FIG. 3) may be used to provide coupling between the pulley 52 and the piston 49. An additional support bracket (not shown in the FIG. 3) can also be attached between fixed height first member 43 and the cylinder 48 close to the cylinder upper end 54 to make sure that the gas spring 47 maintains its orientation relative to the fixed height first member 43 during the height adjustment 31. A tension member 55 can be attached between fixed height first member 43 and a second member 36 which can be moveable. The tension member 55 can be any linear connecting member such as a rope, a chain, a wire, a cable or belt. A tension member first end 56 can be fixedly attached to the fixed height first member 43. The tension member 55 can be routed around the pulley 52, and a tension member second end 57 can be attached to the second member 36. In this disclosure the use of the word "route" or "routing" in regards to tension members has the same meaning as "extend" or "extending". In an example, the tension member 55 can be extended around the pulley 52. In an example configuration such as illustrated in FIG. 3, when the piston 49 of the gas spring 47 moves a distance of X distance, the moving bracket can travel a distance of 2X distance.

Figure 4:
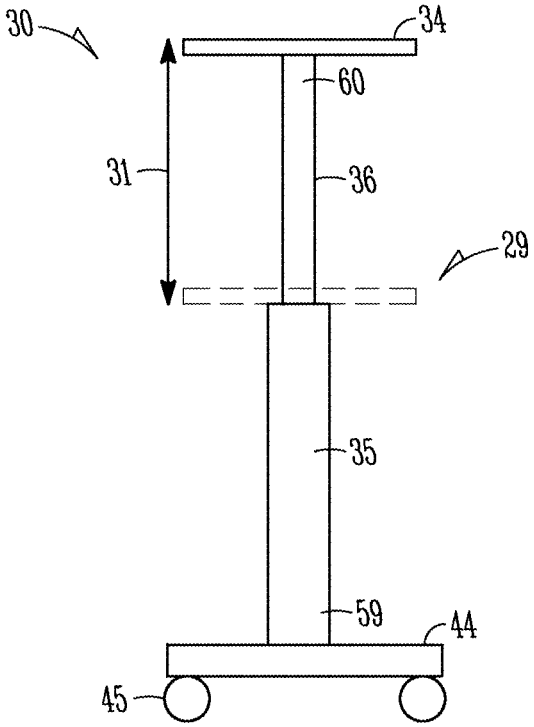
FIG. 4 illustrates a side view of a height adjustable work surface with a two member telescoping leg assembly in accordance with at least one example of this disclosure.

A height adjustable desk 30 with a two member telescoping leg assembly 29 is illustrated in FIG. 4 according to an example of this disclosure. The leg assembly 29 can include a first member 35 and a second member 36 and the second member 36 can be slidably engaged with first member 35. The first member 35 can be fixedly attached to a base 44 at a first member bottom end 59. The second member 36 can move in and out of the first member 35 during a height adjustment 31 thereby changing the total height of the leg assembly 29. A work surface 34 can be attached to a second member upper end 60. The height of the work surface 34 can be adjusted as the height of the leg assembly 29 is varied. A counterbalance mechanism 46 (See FIG. 3) contained inside the leg assembly 29 provides lift assist during the height adjustment 31. The counterbalance mechanism 46 can carry at least part of the combined weight of the second member 36, work surface 34, and any components that may be located on the work surface 34. The base 44 can include casters 45 to provide a moveable unit.

Figures 5A, 5B:
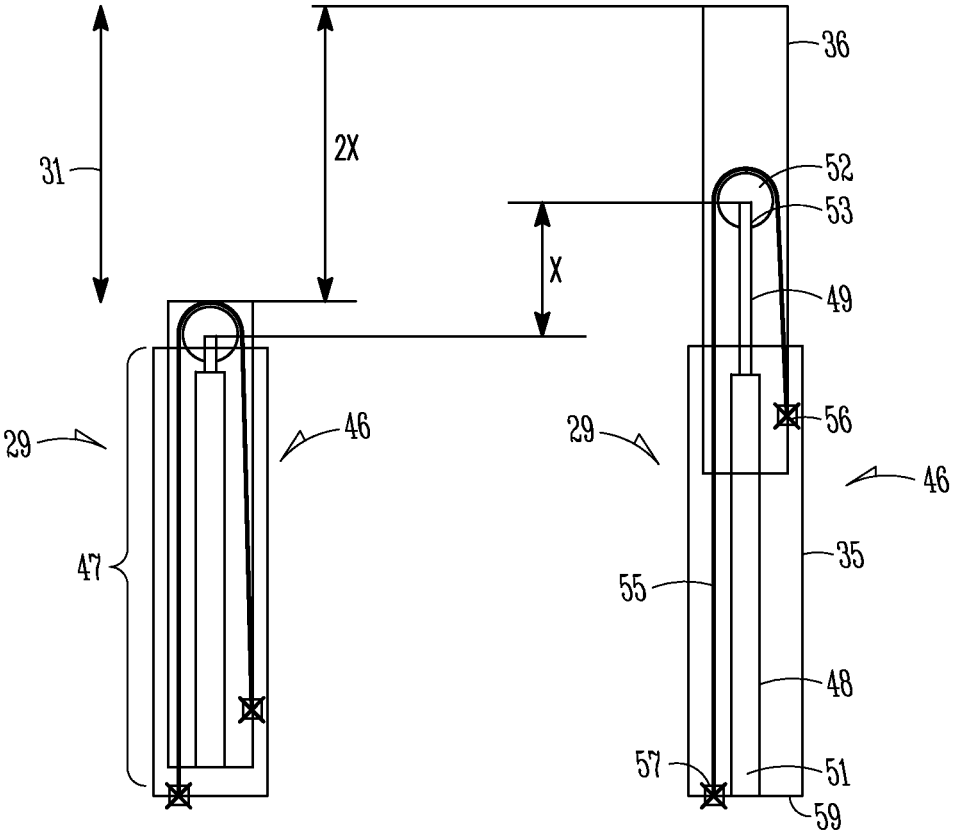
FIGS. 5A-B illustrate a side view of a counterbalance mechanism using a gas spring in accordance with at least one example of this disclosure.

FIGS. 5A-5B illustrate a side view of a counterbalance mechanism using a gas spring in accordance with at least one example of this disclosure. A leg assembly 29 can include a counterbalance mechanism 46 having a gas spring 47. The leg assembly 29 can include a telescoping configuration of a first member 35 and a second member 36. A cylinder base 51 can be fixedly attached to a first member bottom end 59. A piston 49 can be allowed to move in/out of the cylinder 48 during a height adjustment 31. A pulley 52 can be rotatingly coupled with the piston 49 on a piston outer end 53. An interface bracket (not shown in FIGS. 5A-5B) may be used to provide coupling between the pulley 52 and the piston 49. A tension member 55 can be attached between the first member 35 and the second member 36. A tension member first end 56 can be fixedly attached to the second member 36. The tension member 55 can be routed around the pulley 52, and a tension member second end 57 can be fixedly attached to the first member 35. Attachment locations for the tension member 55 to the first member 35 and second member 36 can vary depending on the application. With the configuration illustrated in FIGS. 5A-5B, when the piston 49 of the gas spring 47 can move X distance, the second member 36 of the leg assembly 29, and thus, the work surface 34 (see FIG. 4) can move 2X distance. The gas spring 47 can be locked and the piston 49 will not move in or out of the cylinder 48. Since the pulley 52 can be fixedly attached to the piston 49, it will not be possible to lower the second member 36 when the gas spring 47 is locked. Locking the gas spring 47 in this configuration can still allow upward movement of the second member 36. The gas spring 47 can be unlocked, and the piston 49 can move out of the cylinder 48, and thus, push the second member 36 upwardly.

Figure 6:
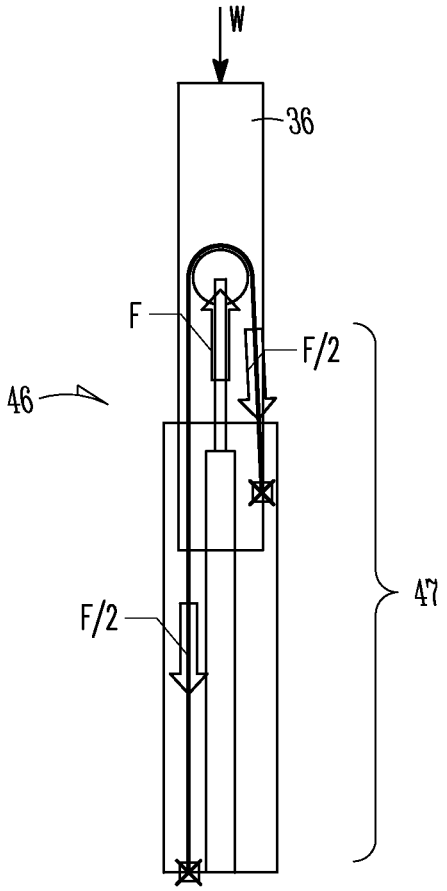
FIG. 6 illustrates a force distribution diagram for a gas spring counterbalance mechanism in accordance with at least one example of this disclosure.

FIG. 6 illustrates a force distribution diagram for a counterbalance mechanism 46 including a gas spring 47 in accordance with at least one example of this disclosure. A counterbalance mechanism 46 can carry at least part of a combined weight W of the second member 36, work surface 34 (see FIGS. 4, 8, 17), and components located on the work surface 34. With a pulley and tension member assembly, half of the total lift force F (or F/2) provided by the gas spring 47 is transferred to the second member 36. Therefore, gas spring lift force F can be properly set such that half of the gas spring force F (or F/2) is approximately equal to the combined weight W of the second member 36, work surface 34, and any components that are located on the work surface. If the counterbalance mechanism 46 provides less force than W to counteract weight W, the desk user can provide additional force to move the work surface upwards. Counterbalance mechanisms can be selected or adjusted to fit a particular desk or work surface and to fit particular loads the work surface might support.

Figure 7A:
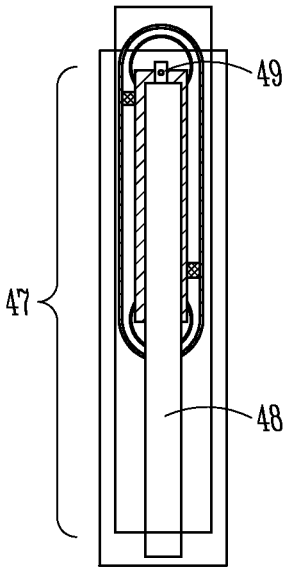
FIGS. 7A-B illustrate a side view of a counterbalance mechanism using a gas spring in accordance with at least one example of this disclosure.
Figure 7B:
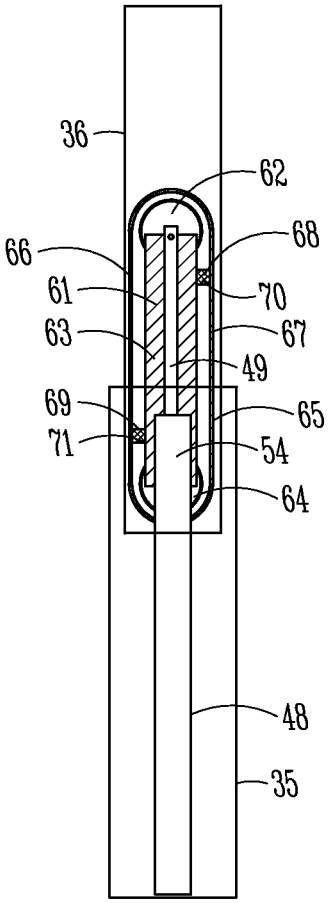

FIGS. 7A-7B illustrate a side view of a another example of a counterbalance mechanism 46 using a gas spring 47 in accordance with at least one example of this disclosure. A pulley bracket 61 can be attached to the piston outer end 53, and the pulley bracket 61 can move with the piston 49. At least part of the pulley bracket 61 can overlap with the cylinder 48. A first pulley 62 can be attached to a pulley bracket upper end 63, and a second pulley 64 can be attached to a pulley bracket lower end 65. A first tension member 66 and a second tension member 67 can engage the first pulley 62 and the second pulley 64. A first tension member first end 68 can be fixedly attached to the second member 36. The first tension member 66 can be routed up and around the first pulley 62, and a first tension member second end 69 can be fixedly attached to the cylinder upper end 54. Since the cylinder 48 can be fixedly attached to the first member 35, attaching the first tension member 66 to the cylinder 48 is similar to attaching the first tension member 66 to the first member 35. In other examples, various other means such as a separate rod, or bracket may be employed to attach the first tension member second end 69 to the first member 35. A second tension member first end 70 can be fixedly attached to second member 36. The second tension member 67 can be routed down and around the second pulley 64, and a second tension member second end 71 can be fixedly attached to the cylinder 48. The counterbalance mechanism 46 illustrated in FIGS. 7A-7B can operate in the same manner as the counterbalance mechanism 46 illustrated in FIGS. 5A-5B. In this configuration, the cylinder 48 can be locked and a work surface 34 (see FIG. 4) cannot be moved upwardly or downwardly.

Figure 8:
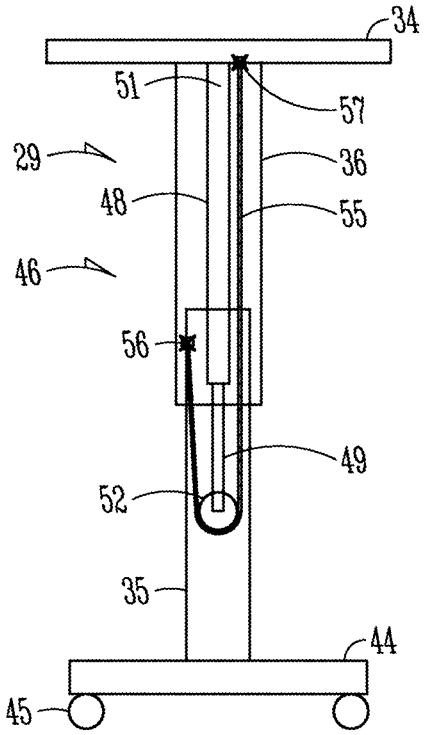
FIG. 8 illustrates a side view of a height adjustable work surface with a two member telescoping leg assembly and a gas spring attached to a second member in accordance with at least one example of this disclosure.

FIG. 8 illustrates a side view of a height adjustable work surface with a two member telescoping leg assembly and a gas spring attached to a second member in accordance with at least one example of this disclosure. In the counterbalance mechanisms illustrated in FIGS. 4-7, the cylinder 48 can be fixedly attached to the first member 35. In alternative examples, the cylinder 48 of FIGS. 4-7 can be attached to the second member 36 as illustrated in FIG. 8 without changing the general intent of this disclosure. The counterbalance mechanism 46 can still function in a similar manner. As illustrated in FIG. 8, a leg assembly 29 can include a first member 35 and a second member 36 attached to a base 44. The base 44 can include casters 45. The cylinder base 51 can be attached to a work surface 34 or the upper end of the second member 36. The piston 49 can move outwardly from the bottom of the second member 36 and include a pulley 52 and a tension member 55. The tension member 55 can be attached to the first member 35 at a tension member first end 56 and the second member 36 at a tension member second end 57.

Figure 9:
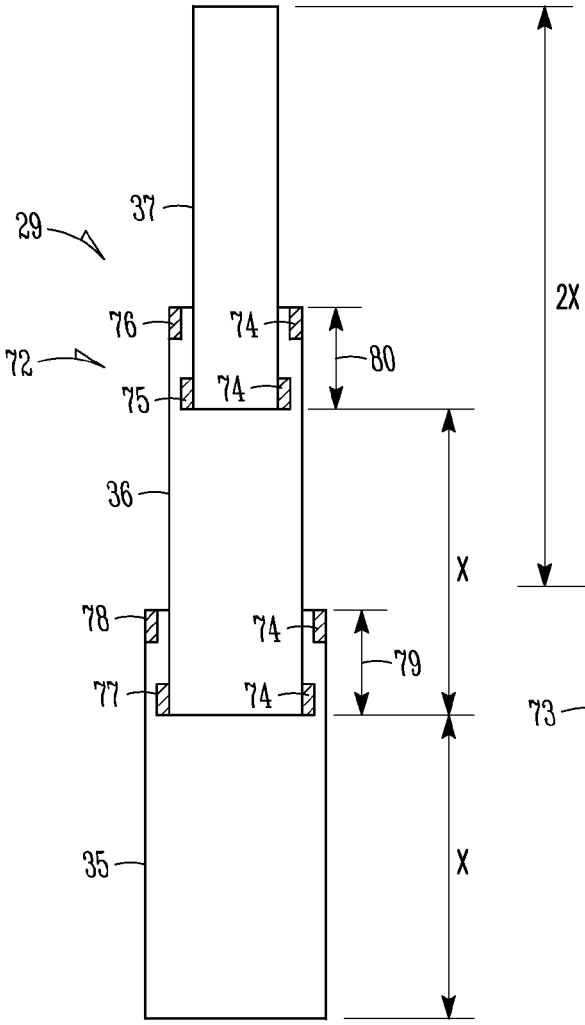
FIG. 9 illustrates a side view of a three member leg assembly in an extended position in accordance with at least one example of this disclosure.
Figure 10:
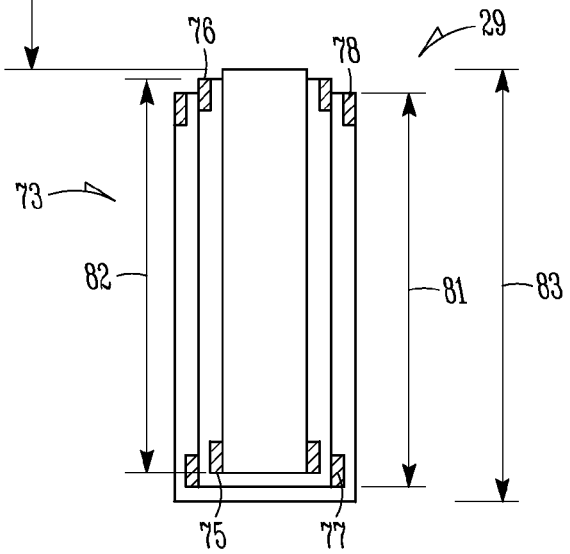
FIG. 10 illustrates a side view of a three member leg assembly in a collapsed position in accordance with at least one example of this disclosure.

FIG. 9 illustrates a side view of a three member leg assembly 29 in an extended position 72 in accordance with at least one example of this disclosure. FIG. 10 illustrates a side view of a three member leg assembly 29 in a collapsed position 73 in accordance with at least one example of this disclosure. The three member leg assembly 29 can include a first member 35, a second member 36 and a third member 37 and the first, second and third members, 35, 36, 37 can be tubular in cross-section, and they may have any cross-sectional shape including but not limited to round, square, rectangular, oval or other profiles. The second member 36 can be slidably engaged with the first member 35, and the third member 37 can be slidably engaged with the second member 36. The movement or sliding of each member relative to an adjacent member can be synchronized as described in the following paragraphs. If the second member slides X distance relative to the first member 35, then the third member 37 can also slide X distance relative to the second member 36, and total travel for the third member 37 relative to the first member 35 can be equal to 2X distance.

Glides 74 (described in more detail below) can be located between each member at certain locations to provide smooth gliding between the first, second and third members, 35, 36, 37, and to provide structural support for a height adjustable desk 30 (see FIGS. 1, 4, 8, 17) to prevent any undesired wobble. A set of glides 74 can be attached to the third member bottom outer edge 75, to a second member top inner edge 76 and a second member bottom outer edge 77, and to a first member top inner edge 78 as illustrated in in FIG. 9 according to an example of this disclosure. However, other glide orientations are also possible. In some configurations, vertical slides can be used between members instead of glides 74. In the extended position 72, a distance between adjacent glides 74 can be the smallest. The extended position 72 can provide first minimum overlap 79 between the adjacent glides 74 at the second member bottom outer edge 77 and the first member top inner edge 78. The extended position 72 can provide second minimum overlap 80 between the adjacent glides 74 at the third member bottom outer edge 75 and the second member top inner edge 76.

In the collapsed position 73, adjacent glides 74 move away from each other. This can provide the maximum distance between the adjacent glides 74, and the collapsed position 73 can provide a first maximum overlap 81 between the adjacent glides 74 at the second member bottom outer edge 77 and the first member top inner edge 78. The collapsed position 73 can provide second maximum overlap 82 between the adjacent glides 74 at the third member bottom outer edge 75 and the second member top inner edge 76. In the collapsed position 73, telescoping members of the leg assembly 29 nests inside one another, and provide the smallest overall height 83 of the leg assembly 29. Such a configuration can be advantageous because lower work surface heights can be achievable without decreasing the overlap between the members or without reducing the distance of total height adjustment for the work surface 34 (see FIGS. 4, 8, 17). Distance X can be a travel distance of the third member 37 relative to the second member 36 and also a similar distance X can be the travel of the second member 36 relative to the first member 35. Distance 2X can be the travel distance of the third member 37 relative to the first member 35.

Figure 11:
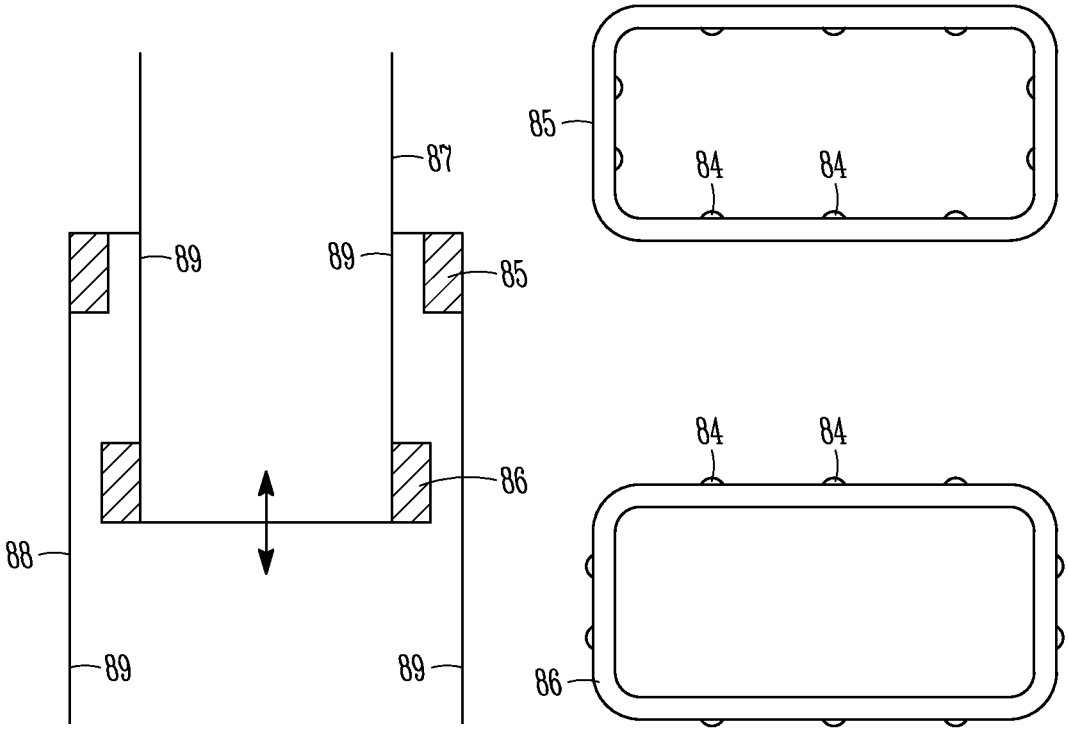
FIG. 11 illustrates glide members for upper and lower telescoping members in accordance with at least one example of this disclosure.

FIG. 11 illustrates glide members for upper and lower telescoping members in accordance with at least one example of this disclosure. Glides 74 can be made of one-piece molded plastic. However, in some configurations, multiple pieces of molded plastic glides, or tapes made up of low friction materials such as Teflon can be used as gliding surfaces between the adjacent telescoping members. Molded plastics can include bumps 84 to provide smaller contact surfaces between the telescoping members to lower the friction as illustrated in FIG. 11. Grease can be used over the gliding surfaces to reduce friction. In other configurations, glides can be replaced by vertical slides to guide the telescoping members 93 relative to each other. In an example, cross-sectional configurations of an outer glide 85 and an inner glide 86 can include a rectangular shape. The inner glide 86 can be attached to the outer surface of an inner tube 87, while an outer glide 85 can be attached to an inner surface of an outer tube 88. The bumps 84 can engage a gliding surface 89 of an adjacent tube.

Figure 12:
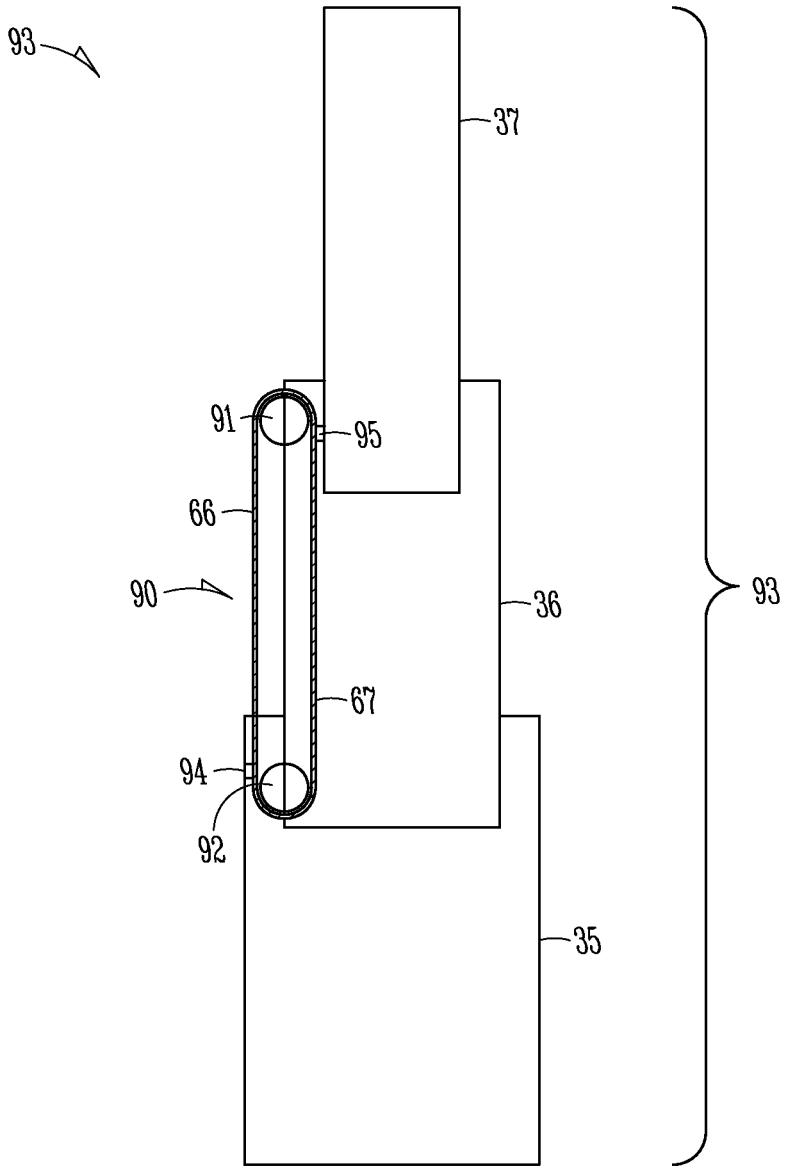
FIG. 12 illustrates a side view of a three member leg assembly including an idler pulley assembly in accordance with at least one example of this disclosure.

FIG. 12 illustrates a side view of a three member leg assembly 29 including an idler pulley assembly 90 in accordance with at least one example of this disclosure. An idler pulley assembly 90 can include first and second idler pulleys 91, 92, and first and second tension members 66, 67. Telescoping members 93 of the leg assembly 29 can be connected to each other via the idler pulley assembly 90 to ensure that second and third members 36, 37 move in synchronization, and to ensure that the second and third members 36, 37 do not slip relative to each other. Both first and second idler pulleys 91, 92 can be rotatingly coupled to the second member 36. A first tension member 66 can be routed around the first idler pulley 91 and can be attached to the first member 35 on one end at a first crimp 94 location, and can be attached to the second member 36 on the other end at a second crimp 95 location. A second tension member 67 can be routed around the second idler pulley 92 and can be attached to the first member 35 on one end at the first crimp 94 locations, and attached to the third member 37 on the other end at the second crimp 95 location. The configuration shown in FIG. 12 is for illustrative purposes only and should not be construed as limiting this disclosure. The idler pulleys 91, 92 can be attached to the second member 36 in many different locations to satisfy the geometric restrictions of the design. In some configurations, the first tension member 66 and the second tension member 67 can be parts of one continuous loop, and the one continuous loop can be attached to the first member 35 and third member 37 at first crimp 94 and second crimp 95 locations, respectively. In other configurations, first and second idler pulleys 91, 92 can be located on opposite sides of the telescoping members 93, and the first crimp 94 and second crimp 95 locations can be different for the first tension member 66 and the second tension member 67. The tension members can be non-metallic rope, chain, steel cable, belting or any other flexible element.

Figure 13:
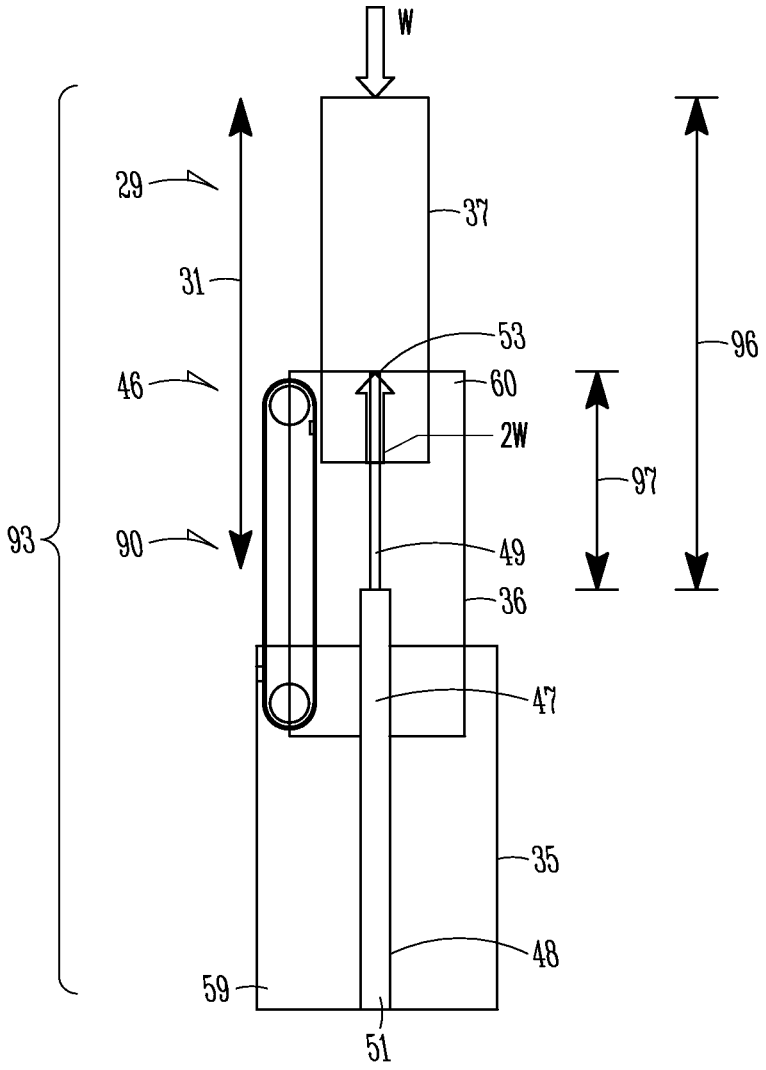
FIG. 13 illustrates a side view of a counterbalance mechanism using a gas spring in a three member telescoping leg assembly in accordance with at least one example of this disclosure.

FIG. 13 illustrates a side view of a counterbalance mechanism 46 using a gas spring 47 in a three member telescoping leg assembly 29 in accordance with at least one example of this disclosure. Movement of the telescoping members 93 of the leg assembly 29 can be synchronized by an idler pulley assembly 90 as explained in association with FIG. 12. A gas spring 47 can be attached between the first member 35 and the second member 36. A cylinder base 51 can be fixedly attached to the first member bottom end 59. The piston outer end 53 can be attached to a second member upper end 60. The second member 36 can move with the piston 49 during a height adjustment 31. In this configuration, a total travel 96 of the third member 37 can be twice as long as a stroke 97 of the piston 49 and a gas spring force 2W can be two times the desired weight W that can be counterbalanced.

Figure 14:
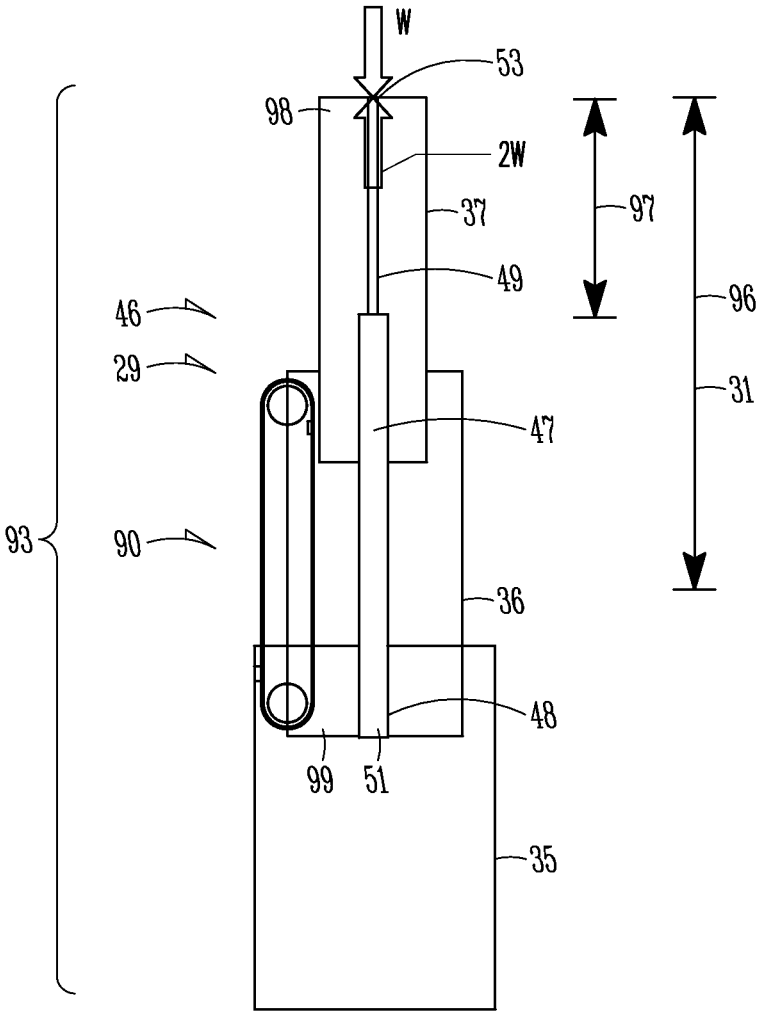
FIG. 14 illustrates a side view of a counterbalance mechanism using a gas spring in a three member telescoping leg assembly in accordance with at least one example of this disclosure.

FIG. 14 illustrates a side view of a counterbalance mechanism 46 using a gas spring 47 in a three member telescoping leg assembly 29 in accordance with at least one example of this disclosure. Movement of the telescoping members 93 of the leg assembly 29 can be synchronized by the idler pulley assembly 90 as explained in association with FIG. 12. A gas spring 47 can be attached between a second member 36 and a third member 37. The cylinder base 51 can be fixedly attached to the second member bottom end 99. The piston outer end 53 can be attached to a third member upper end 98. A displacement or travel of the third member 37 relative to the second member 36 can be the same displacement as the stroke 97 of the piston 49 during the height adjustment 31. In this configuration, total travel 96 of the third member 37 can be twice as long as the stroke 97 and gas spring force 2W can be two times the desired weight W that can be counterbalanced.

Figure 15:
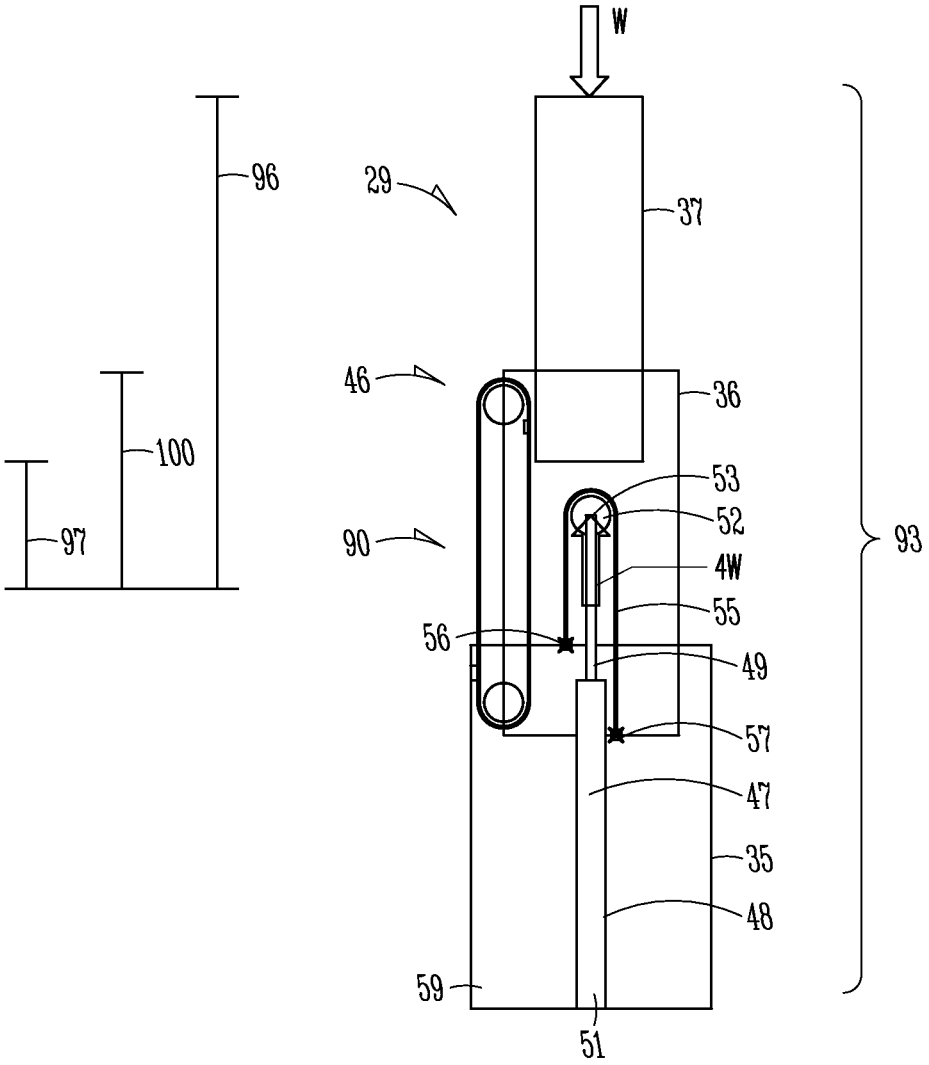
FIG. 15 illustrates a side view of a counterbalance mechanism using a gas spring in a three member telescoping leg assembly in accordance with at least one example of this disclosure.

FIG. 15 illustrates a side view of a counterbalance mechanism 46 using a gas spring 47 in a three member telescoping leg assembly 29 in accordance with at least one example of this disclosure. Movement of the telescoping members 93 of the leg assembly 29 can be synchronized by the idler pulley assembly 90 as explained above in association with FIG. 12. In this configuration, the cylinder base 51 can be fixedly attached to the first member bottom end 59. The piston 49 can be free to move in/out of the cylinder 48. A pulley 52 can be rotatingly coupled to the piston outer end 53. A tension member 55 can be attached between the first member 35 and the second member 36. The tension member first end 56 can be fixedly attached to the first member 35. The tension member 55 can be routed up and around the pulley 52 and the tension member second end 57 can be fixedly attached to the second member 36. In this configuration, the second member 36 can include a displacement 100 that is twice the distance of the stroke 97 of the piston 49. The total travel 96 of the third member 37 can be four times the stroke of the piston 49, and gas spring force 4W can be four times the desired weight W that can be counterbalanced.

Figure 16:
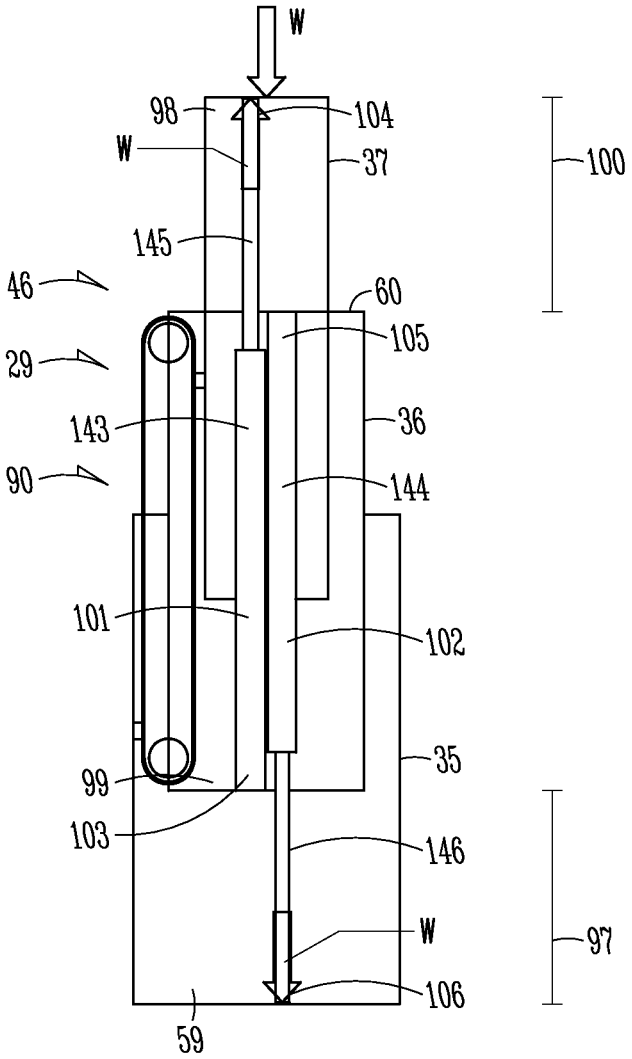
FIG. 16 illustrates a side view of a counterbalance mechanism using a gas spring in a three member telescoping leg assembly in accordance with at least one example of this disclosure.

FIG. 16 illustrates a three member telescoping leg assembly 29 in another example that can include two gas springs. A counterbalance mechanism 46 can include a first gas spring 101 and second gas spring 102. The first gas spring 101 can include a first piston 145 and a first cylinder 143. The second gas spring 102 can include a second piston 146 and a second cylinder 144. In this configuration, first and second gas springs 101, 102 can be attached to the second member 36. A first cylinder base 103 can be fixedly attached to the second member bottom end 99. A first piston outer end 104 can be fixedly attached to the third member upper end 98. The displacement 100 of the third member 37 relative to the second member 36 can be the same as the stroke 97 of the first gas spring 101. The second gas spring 102 can be oriented upside down relative to the first gas spring 101. The second cylinder base 105 can be fixedly attached to the second member upper end 60. The second piston outer end 106 can be fixedly attached to the first member bottom end 59. The displacement 100 of the second member 36 relative to the first member 35 can be the same as the stroke 97 of the second gas spring 102. Each gas spring force can be equivalent to the desired weight that can be counterbalanced. An idler pulley assembly 90 (see FIG. 12) is not needed to build this lift mechanism. The counterbalance mechanism 46 will function without the idler pulley assembly 90. However, to synchronize the telescoping motion between the first member 35 and the second member 36 with the telescoping motion between the second member 36 and the third member 37, an idler pulley assembly 90 can be used.

Various examples of the height adjustment mechanisms are described in previous sections in association with FIGS. 5-16 for a work surface 34 supported by a single leg assembly 29. However, multiple leg assemblies 29 can be used for a height adjustment 31. When two or more leg assemblies 29 are used for height adjustment 31, displacement 100 in each leg can be synchronized to maintain the work surface 34 in a horizontal position 107 (see FIG. 17).

Figure 17:
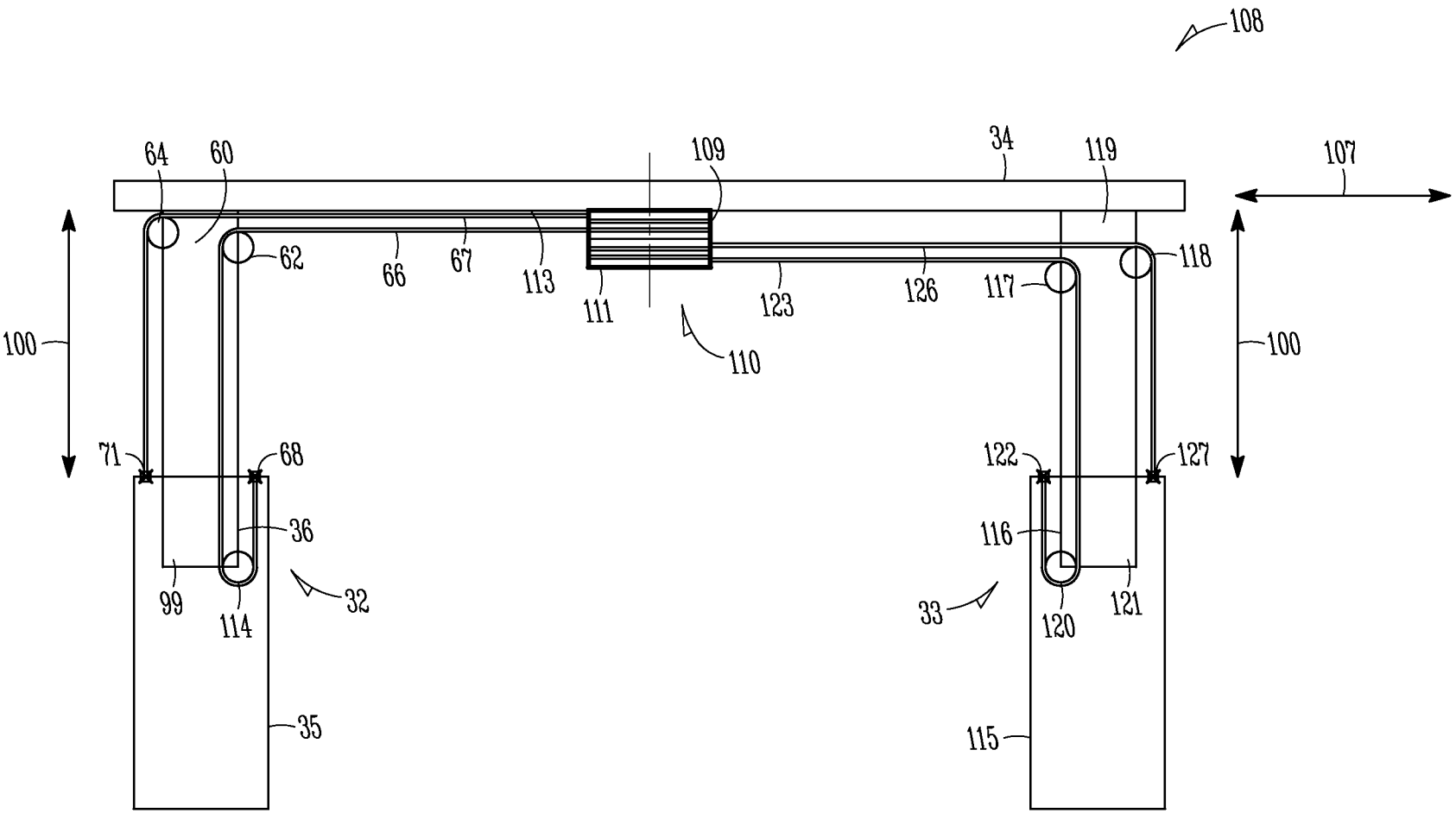
FIG. 17 illustrates a front view of a synchronizing pulley assembly in accordance with at least one example of this disclosure.

FIG. 17 illustrates a front view of a synchronizing pulley assembly 108 in accordance with at least one example of this disclosure. A work surface 34 can be supported by two leg assemblies 29. Each leg assembly 29 can contain a counterbalance mechanism 46 to carry the weight of the work surface 34 as well as any equipment that would be located on the work surface 34. Any one of the counterbalance mechanisms 46 that were described in earlier sections of this disclosure can be located inside at least one of the leg assemblies 29, but this disclosure should not be construed as limited to the counterbalance mechanisms described herein and any counterbalance mechanism that can be connected to the leg assemblies 29 or located under the work surface 34 can be used. Therefore, the counterbalance mechanism 46 is not shown in FIGS. 17-21 for clarity and should not be construed as limiting this disclosure.

Figure 18:
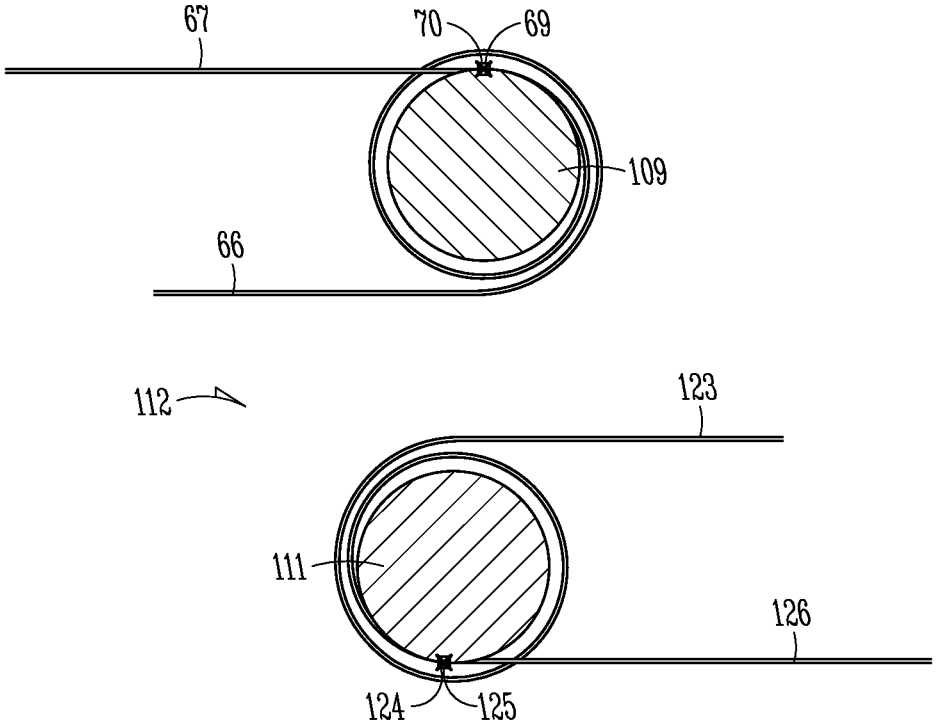
FIG. 18 illustrates a plan view of upper and lower wheels and tension member routing in accordance with at least one example of this disclosure.

The synchronizing pulley assembly 108 can include a central wheel assembly 110. The central wheel assembly 110 can also be referred to as a "wheel assembly" and does not need to be centrally located in the height adjustable desk. The central wheel assembly 110 can include an upper wheel 109 and a lower wheel 111. The upper wheel 109 and the lower wheel 111 can also be referred to as a "first wheel" and a "second wheel" and in an example are in a stacked configuration. A corresponding plan view of the upper wheel 109 and the lower wheel 111 and tension member routing 112 around the wheels is shown in FIG. 18. FIGS. 17-18 can correspond to a highest position of the height adjustment mechanism. A central wheel assembly 110 can be rotatingly coupled to the underside 113 of the work surface 34. The upper wheel 109 and the lower wheel 111 can be fixedly attached to each other, therefore they can rotate in unison.

A first leg assembly 32 can be fixedly attached to the underside 113 of the work surface 34. The first leg assembly 32 can include a first member 35 and a second member 36. The second member 36 can be slidably engaged with the first member 35. A first pulley 62 and a second pulley 64 can be rotatingly coupled to the first leg assembly 32 close to the second member upper end 60. A third pulley 114 can be rotatingly coupled with the second member 36 of the first leg assembly 32 close to the second member bottom end 99. A first tension member first end 68 can be fixedly attached to the first member 35 of the first leg assembly 32. The first tension member 66 can be routed down and around the third pulley 114 to direct the first tension member 66 upwardly. The first tension member 66 can be further routed around the first pulley 62 towards the upper wheel 109. The first tension member 66 can make one or more full turns around the upper wheel 109, and a first tension member second end 69 can be fixedly attached to the upper wheel 109 as illustrated in FIG. 18. A second tension member first end 70 can be fixedly attached to the upper wheel 109. The second tension member 67 can be routed around the second pulley 64 downwards, and a second tension member second end 71 can be fixedly attached to the first member 35 of the first leg assembly 32. In some configurations, the first tension member 66 and second tension member 67 can be portions of one long tension member. In such a case as having one long tension member, the long tension member can be fixedly attached to the upper wheel 109 as described above to prevent any slippage.

A second leg assembly 33 can be fixedly attached to the underside 113 of the work surface 34. The second leg assembly can include a third member 115 and a fourth member 116. The fourth member 116 can be slidably engaged with the third member 115. A fourth pulley 117 and a fifth pulley 118 can be rotatingly coupled to the fourth member 116 of the second leg assembly 33 close to the fourth member upper end 119. A sixth pulley 120 can be rotatingly coupled with the fourth member 118 of the second leg assembly 33 close to the fourth member bottom end 121. A third tension member first end 122 can be fixedly attached to the third member 115 of the second leg assembly 33. The third tension member 123 can be routed down and around the sixth pulley 120 to direct the third tension member 123 upwardly. The third tension member 123 can be further routed around the fourth pulley 117 towards the lower wheel 111. The third tension member 123 can make one or more full turns around the lower wheel 111, and a third tension member second end 124 can be fixedly attached to the lower wheel 111 as illustrated in FIG. 18. The fourth tension member first end 125 can be fixedly attached to the lower wheel 111. The fourth tension member 126 can be routed around the fifth pulley 118 downwardly, and a fourth tension member second end 127 can be fixedly attached to the third member 115 of the second leg assembly 33. In some configurations, the third tension member 123 and fourth tension member 126 can be portions of one long tension member. In such a case as having one long tension member, the long tension member can be fixedly attached to the lower wheel 111 as described above to prevent any slippage.

Figure 19:
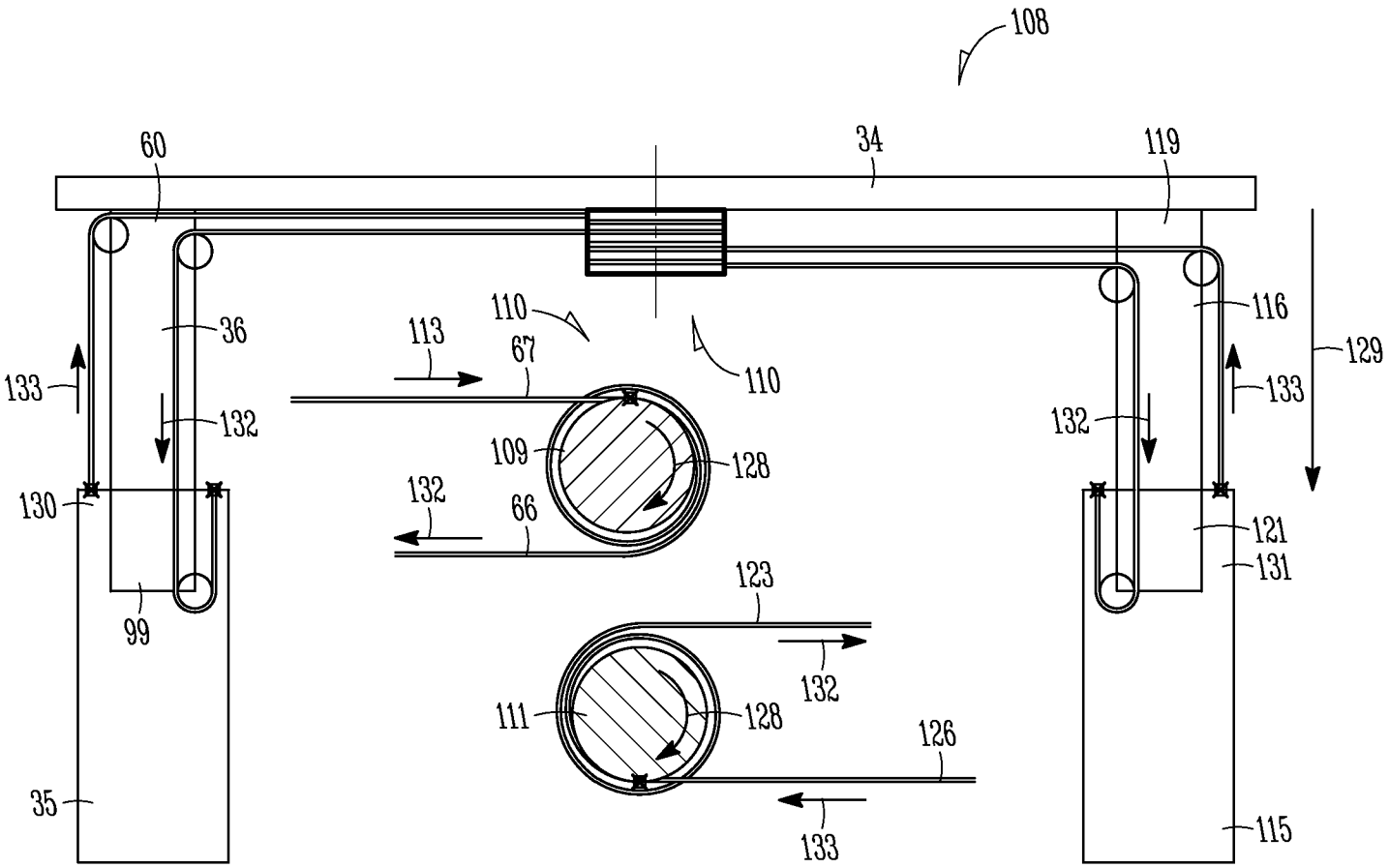
FIG. 19 illustrates a front view of a synchronizing pulley assembly showing wheel rotation and tension member movement in accordance with at least one example of this disclosure.

FIG. 19 illustrates a front view of a synchronizing pulley assembly 108 showing wheel rotation of the central wheel assembly 110 and movement of tension members when the work surface height is lowered. The central wheel assembly 110 can rotate in clockwise direction 128. Although illustrated in a clockwise direction 128, tension members can be rigged in the reverse manner and rotation of the central wheel assembly 110 can be counterclockwise. During the downward movement 129 of the work surface 34, the first tension member 66 and the third tension member 123 can unwrap from the central wheel assembly 110 to provide a tension member length to accommodate for increasing the distance between the first member upper end 130 and the second member bottom end 99 of the first leg assembly 32 and for increasing the distance between the third member upper end 131 and fourth member bottom end 121 of the second leg assembly 33 telescoping legs. Also, during the downward motion of the work surface 34, second tension member 67 and fourth tension member 126 can wrap around the central wheel assembly 110 to take the slack on the tension members due to shortened distance between the first member upper end 130 and the second member upper end 60 and the shortened distance between the third member upper end 131 and the fourth member upper end 119. During the upward movement of the work surface 34, the rotation of the central wheel assembly 110 and motion of the tension members can be reversed.

Figure 20:
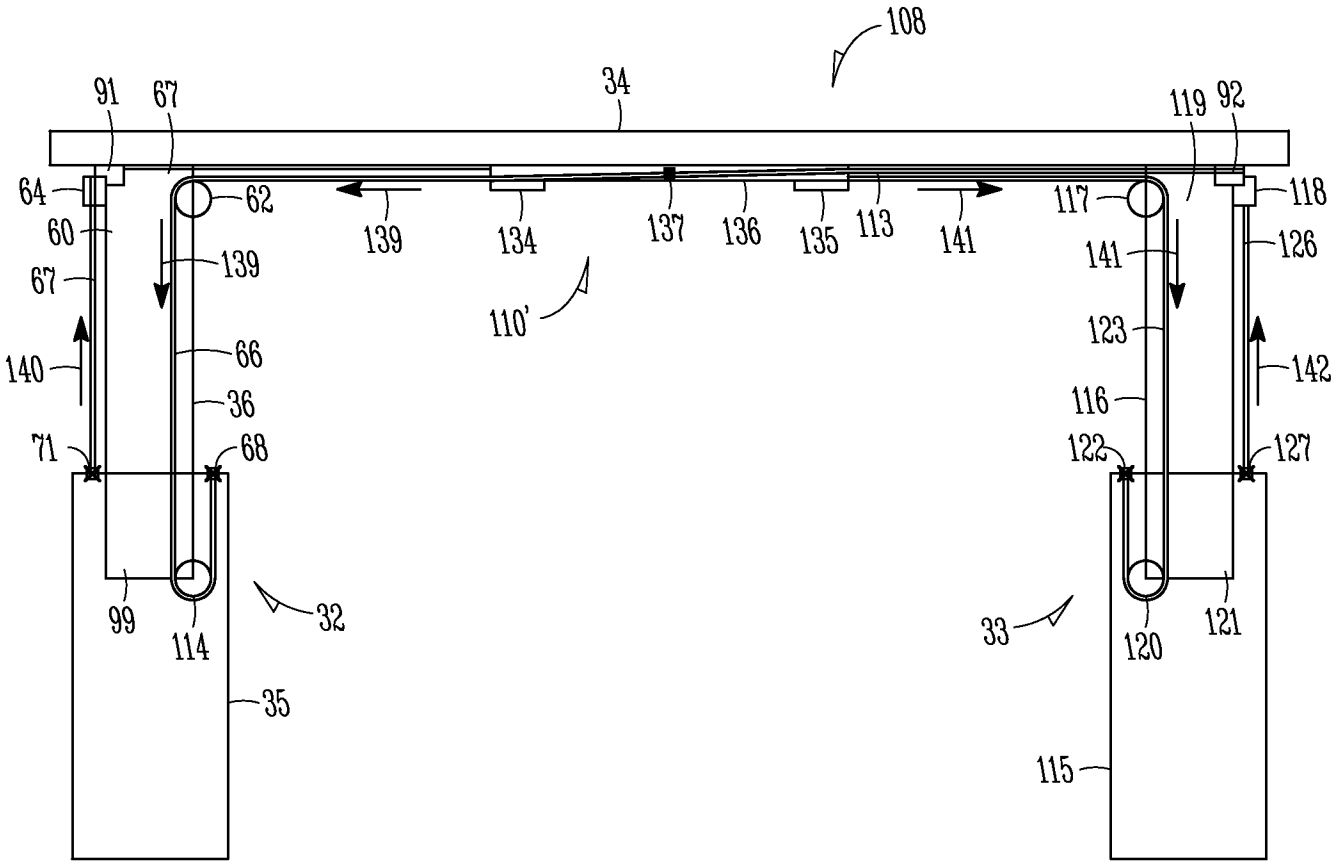
FIG. 20 illustrates a front view of a synchronizing pulley assembly in accordance with at least one example of this disclosure.
Figure 21:
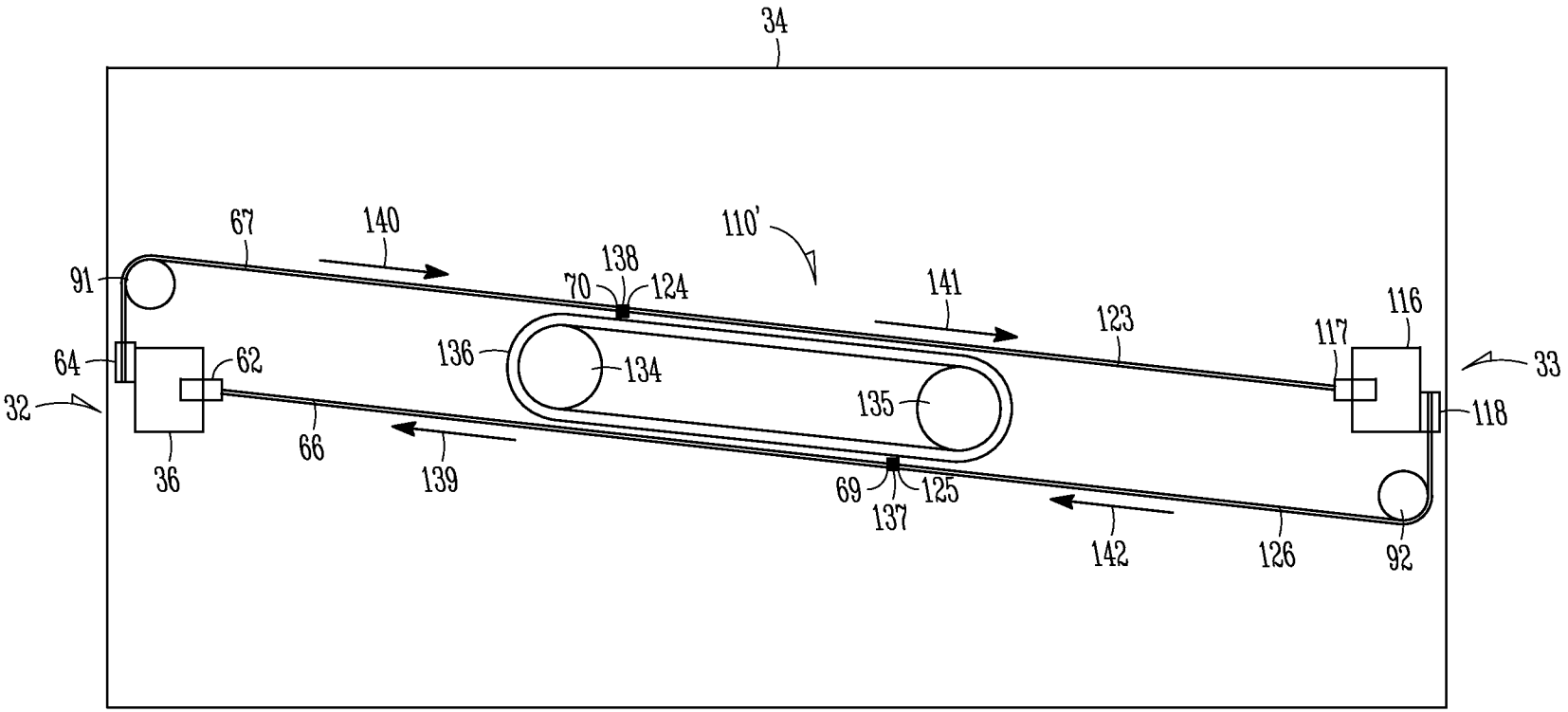
FIG. 21 illustrates a plan view of a synchronizing pulley assembly in accordance with at least one example of this disclosure.

FIG. 20 illustrates a front view of a synchronizing pulley assembly 108 in accordance with at least one example of this disclosure. A corresponding plan view of a connected central wheel assembly 110' is illustrated in FIG. 21. Both FIGS. 20 and 21 can represent the pulley and wheel assemblies for the highest position of the height adjustment mechanism. A first wheel 134 and a second wheel 135 can be attached to the underside 113 of a work surface 34. The first wheel 134 and the second wheel 135 can be rotatingly coupled with the work surface 34. A chain 136 can be wrapped around the first wheel 134 and second wheel 135 so that the first wheel 134 and the second wheel 135 rotate the same distance. A first attachment bracket 137 and a second attachment bracket 138 can be fixedly attached to the chain 136 as illustrated in FIG. 21. The chain 136 can also be configured as any flexible member, such as a belt, a cable, or a rope.

The first leg assembly 32 can be fixedly attached to the underside 113 of the work surface 34. The first leg assembly 32 can include a first member 35 and a second member 36. The second member 36 can be slidably engaged with the first member 35. A first pulley 62 and a second pulley 64 can be rotatingly coupled to the second member 36 of the first leg assembly 32 close to the second member upper end 60. A third pulley 114 can be rotatingly coupled with the second member 36 of the first leg assembly close to the second member bottom end 99. A first idler pulley 91 can be rotatingly coupled with the work surface 34 close to the first leg assembly 32. A first tension member first end 68 can be fixedly attached to the first member 35 of the first leg assembly 32. The first tension member 66 can be routed downwardly and around the third pulley 114 to direct the first tension member 66 upwardly. The first tension member 66 can be further routed around the first pulley 62 towards the connected central wheel assembly 110', and a first tension member second end 69 can be fixedly attached to the first attachment bracket 137 as illustrated in FIG. 21. The second tension member first end 70 can be fixedly attached to the second attachment bracket 138. A second tension member 67 can be routed around the first idler pulley 91 and the second pulley 64 downwardly, and a second tension member second end 71 can be fixedly attached to the first member 35 of the first leg assembly 32.

A second leg assembly 33 can be fixedly attached to the underside 113 of the work surface 34. The second leg assembly 33 can include a third member 115 and a fourth member 116. The fourth member 116 can be slidably engaged with the third member 115. A fourth pulley 117 and a fifth pulley 118 can be rotatingly coupled to the fourth member 116 of the second leg assembly 33 close to the fourth member upper end 119. A sixth pulley 120 can be rotatingly coupled with the fourth member 116 of the second leg assembly 33 close to the fourth member bottom end 121. A second idler pulley 92 can be rotatingly coupled with the work surface 34 close to the second leg assembly 33. A third tension member first end 122 can be fixedly attached to the third member 115 of the second leg assembly 33. The third tension member 123 can be routed down and around the sixth pulley 120 to direct the third tension member 123 upwardly. The third tension member 123 can be further routed around the fourth pulley 117 towards the connected central wheel assembly 110', and the third tension member second end 124 can be fixedly attached to the second attachment bracket 138 as illustrated in FIG. 21. The fourth tension member first end 125 can be fixedly attached to the first attachment bracket 137. The fourth tension member 126 can be routed around the second idler pulley 92 and fifth pulley 118 downwardly, and a fourth tension member second end 127 can be fixedly attached to the third member 115 of the second leg assembly 33.

During the downwards travel of the work surface 34, the first tension member 66 and the second tension member 67 can move in a first direction 139 and a second direction 140, respectively, and the third tension member 123 and the fourth tension member 126 can move in a third direction 141 and a fourth direction 142, respectively, as illustrated in FIGS. 20-21. During the upwards travel of the work surface 34, these directions can be reversed.

In some configurations, the first tension member 66 and the fourth tension member 126 can be parts of one continuous tension member, and one continuous tension member can be attached to the first member 35 and third member 115 at first tension member first end 68 and fourth tension member second end 127 locations, respectively. Such a continuous member can be attached to the flexible member 136 at a midpoint in the continuous member. In such a configuration the second tension member 67 and the third tension member 123 can be parts of one continuous tension member, and the one continuous tension member can be attached to the first member 35 and third member 115 at second tension member first end 71 and third tension member second end 122 locations, respectively.

In other configurations, first and second idler pulleys 91, 92 can be located on opposite sides of the telescoping members 93, and the first crimp 94 and second crimp 95 locations can be different for the first tension member 66 and the second tension member 67.

Although the synchronization methods described above in association with FIGS. 17-21 are described with two member telescoping legs, a similar synchronization method can also be applied to three-member telescoping legs. In the three-member telescoping legs, the same synchronization method can be applied to the second member and third members of the telescoping legs. The second and third members of the telescoping legs are shown in FIGS. 9-16.

Figure 22:
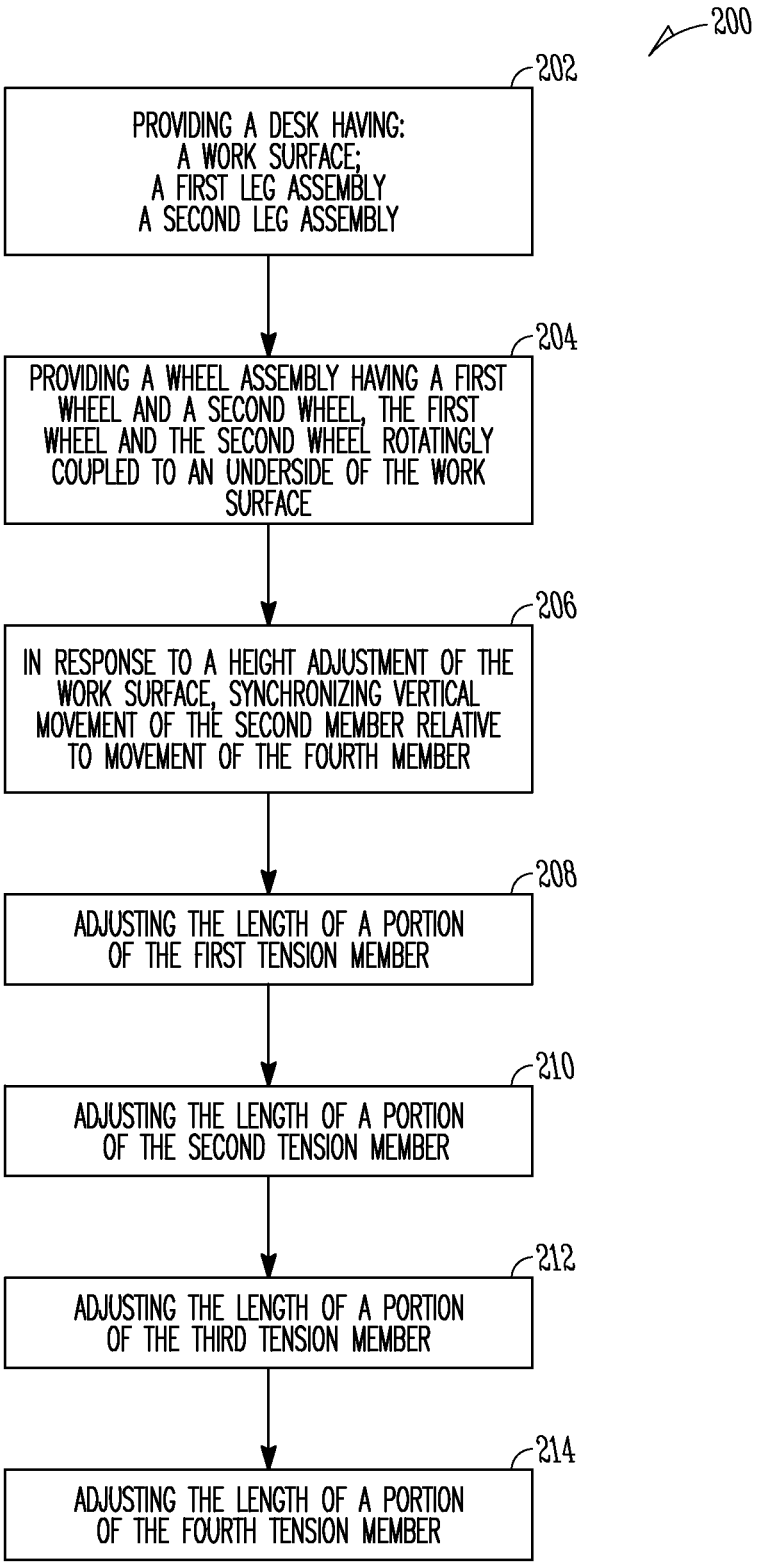
FIG. 22 illustrates a flow chart describing a method of adjusting the height of a work surface in accordance with at least one example of the present subject matter.

FIG. 22 illustrates a flow chart describing a method of adjusting the height of a work surface in accordance with at least one example of the present subject matter. Method 200 includes at 202, providing a desk having: a work surface; a first leg assembly, and a second leg assembly. The first leg assembly can be coupled to the work surface and can include a first member and a second member. The second member can be movable relative to the first member along a longitudinal axis. The first leg assembly can also include a first pulley, rotationally coupled to the second member near the bottom; a second pulley, rotationally coupled to the second member near the top; and a third pulley, rotationally coupled to the second member near the top. The second leg assembly can be coupled to the work surface, and can include a third member and a fourth member. The fourth member can be movable relative to the third member along a longitudinal axis. The second leg assembly can also include a fourth pulley, rotationally coupled to the fourth member near the bottom; a fifth pulley, rotationally coupled to the fourth member near the top; and a sixth pulley, rotationally coupled to the fourth member near the top.

Method 200 includes at 204, providing a wheel assembly, the wheel assembly having a first wheel and a second wheel, the first wheel and the second wheel rotatingly coupled to an underside of the work surface. The wheel assembly can also include a first tension member connected to the wheel assembly and to the first member and a second tension member connected to the wheel assembly and to the first member. The wheel assembly can also include a third tension member connected to the wheel assembly and to the third member and a fourth tension member connected to the wheel assembly and to the third member. The tension members are all connected to either the first member or the third member and to the wheel assembly, so that any movement of the wheel assembly also causes the tension members to move.

Method 200 includes at 206, in response to a height adjustment of the work surface, synchronizing vertical movement of the second member relative to movement of the fourth member. The step of the synchronizing vertical movement can comprise the elements 208-214 outlined below.

Method 200 includes at 208, adjusting the length of a portion of the first tension member. The portion of the first tension member can be located between the first pulley and the connection to the first member. The adjustment in length can be by a first distance.

Method 200 includes at 210, adjusting the length of a portion of the second tension member. The portion of the second tension member can be located between the second pulley and the connection to the first member. The adjustment in length can be by a second distance. The first distance and the second distance can be substantially equal and opposite such that when a first distance is an increase, the second distance is a decrease and when the first distance is a decrease, the second distance is an increase. When the work surface is adjusted upwardly, the portion of first tension member can decrease in length by a first distance and the portion of the second tension member can increase in length by a second distance. When the work surface is adjusted downwardly, the changes in the tension member lengths can be reversed. The portion of first tension member can increase in length by a first distance and the portion of the second tension member can decrease in length by a second distance. The first and second distances can be equal but opposite.

Method 200 includes at 212 adjusting the length of a portion of the third tension member. The portion of the third tension member can be located between the third pulley and the connection to the third member. The adjustment in length can be by the first distance.

Method 200 includes at 214, adjusting the length of a portion of the fourth tension member. The portion of the fourth tension member can be located between the fourth pulley and the connection to the third member. The adjustment in length can be by the second distance.

What is claimed is:

1. A lift mechanism comprising:

a first leg assembly, the first leg assembly including:

a first member; and a second member moveable relative to the first member along a first longitudinal axis;

a second leg assembly, the second leg assembly including:

a third member; and a fourth member moveable relative to the third member along a second longitudinal axis; and a synchronization assembly connecting the first and second leg assemblies, the synchronization assembly configured to balance movement between the first and second leg assemblies, the synchronization assembly including:

a first tension member and a second tension member;

a wheel assembly connected to the first tension member and the second tension member, the first tension member connected to at least one of the first leg assembly and the second leg assembly and the second tension member connected to at least one of the first leg assembly and the second leg assembly; and a third tension member connected to the wheel assembly and a fourth tension member connected to the wheel assembly.

2. The lift mechanism of claim 1, wherein the wheel assembly comprises a first wheel and a second wheel, the first wheel and the second wheel rotatingly coupled to an underside of a work surface.

3. The lift mechanism of claim 2, wherein the first wheel is affixed to the second wheel and the first wheel and the second wheel have a shared axis of rotation.

4. The lift mechanism of claim 2, wherein the first wheel and the second wheel are integrally formed and have a shared axis of rotation.

5. The lift mechanism of claim 2, wherein the wheel assembly comprises a flexible member extending around at least a portion of each of the first wheel and the second wheel, the first wheel and the second wheel configured to rotate in unison when the flexible member moves.

6. The lift mechanism of claim 1, wherein the first tension member and the second tension member each form a continuous tension member with a midpoint attachment to the wheel assembly, the first tension member having two ends attached to at least one of the first leg assembly and the second leg assembly, the second tension member having two ends attached to at least one of the first leg assembly and the second leg assembly.

7. The lift mechanism of claim 1, comprising:

a first pulley rotationally attached near the top of the second member;

a second pulley rotationally attached near the top of the second member; and a third pulley rotationally attached near the bottom of the second member, wherein the first tension member extends around the first pulley and the third pulley and is attached to the first member.

8. The lift mechanism of claim 1, comprising:

a fourth pulley rotationally attached near the top of the fourth member;

a fifth pulley rotationally attached near the top of the fourth member; and a sixth pulley rotationally attached near the bottom of the fourth member, wherein the third tension member extends around the fourth pulley and the sixth pulley and is attached to the third member.

9. The lift mechanism of claim 1, comprising:

a first idler pulley rotationally attached to an underside of a work surface; and a second idler pulley rotationally attached to the underside of the work surface.

10. The lift mechanism of claim 1, comprising:

a counterbalance mechanism connected to the lift mechanism and configured to counteract a force exerted on a work surface, the counterbalance mechanism including:

a gas spring having a cylinder and a moveable piston; and a wheel moveably connected to the gas spring; and a counterbalance tension member engaged to the wheel; the counterbalance tension member connected to at least one of the first leg assembly and the second leg assembly.

11. The lift mechanism of claim 10, wherein the first leg assembly includes a first gas spring of a first counterbalance mechanism and the second leg assembly includes a second gas spring of a second counterbalance mechanism.

12. The lift mechanism of claim 10, wherein the gas spring is attached to the underside of the work surface.

13. The lift mechanism of claim 1, wherein the first leg assembly includes a fifth member moveable relative to the second member, and wherein the second leg assembly includes a sixth member moveable relative to the fourth member.

14. The lift mechanism of claim 13, comprising:

a counterbalance mechanism configured to counteract a force exerted on a work surface, the counterbalance mechanism including:

a first gas spring having a moveable piston slidably attached to a cylinder, the cylinder attached to a first end of one of the second member and the fourth member;

a second gas spring attached to a second end of the one of the second member and the fourth member, the second gas spring extending in an opposite direction from the first gas spring.

15. A height adjustable desk comprising:

a first leg assembly connected to a work surface, the first leg assembly including:

a first member; and a second member moveable relative to the first member along a first longitudinal axis;

a second leg assembly connected to the work surface, the second leg assembly including:

a third member; and a fourth member moveable relative to the third member along a second longitudinal axis; and a synchronization assembly connecting the first and second leg assemblies, the synchronization assembly configured to balance movement between the first and second leg assemblies, the synchronization assembly including:

a first tension member and a second tension member;

a wheel assembly connected to the first tension member and the second tension member, the first tension member connected to at least one of the first leg assembly and the second leg assembly and the second tension member connected to at least one of the first leg assembly and the second leg assembly; and a third tension member connected to the wheel assembly and a fourth tension member connected to the wheel assembly.

16. The height adjustable desk of claim 15, wherein the wheel assembly comprises a first wheel and a second wheel, the first wheel and the second wheel rotatingly coupled to an underside of the work surface.

17. A lift mechanism comprising:

a first leg assembly, the first leg assembly including:

a first member; and a second member moveable relative to the first member along a first longitudinal axis;

a second leg assembly, the second leg assembly including:

a third member; and a fourth member moveable relative to the third member along a second longitudinal axis; and a synchronization assembly connecting the first and second leg assemblies, the synchronization assembly configured to balance movement between the first and second leg assemblies, the synchronization assembly including:

a first tension member and a second tension member;

a wheel assembly connected to the first tension member and the second tension member, the first tension member connected to at least one of the first leg assembly and the second leg assembly and the second tension member connected to at least one of the first leg assembly and the second leg assembly; and a counterbalance mechanism connected to the lift mechanism and configured to counteract a force exerted on a work surface, the counterbalance mechanism including:

a gas spring having a cylinder and a moveable piston;

a wheel moveably connected to the gas spring; and a counterbalance tension member engaged to the wheel, the counterbalance tension member connected to at least one of the first leg assembly and the second leg assembly.

18. A lift mechanism comprising:

a first leg assembly, the first leg assembly including:

a first member; and a second member moveable relative to the first member along a first longitudinal axis;

a second leg assembly, the second leg assembly including:

a third member; and a fourth member moveable relative to the third member along a second longitudinal axis; and a synchronization assembly connecting the first and second leg assemblies, the synchronization assembly configured to balance movement between the first and second leg assemblies, the synchronization assembly including:

a first tension member and a second tension member;

a wheel assembly connected to the first tension member and the second tension member, the first tension member connected to at least one of the first leg assembly and the second leg assembly and the second tension member connected to at least one of the first leg assembly and the second leg assembly, the wheel assembly including:

a first wheel and a second wheel, the first wheel and the second wheel rotatingly coupled to an underside of a work surface; and a flexible member extending around at least a portion of each of the first wheel and the second wheel; the first wheel and the second wheel configured to rotate in unison when the flexible member moves.

* * * * *